US008752774B2

(12) United States Patent
Haba

(10) Patent No.: US 8,752,774 B2
(45) Date of Patent: Jun. 17, 2014

(54) FUEL INJECTION CONTROL DEVICE OF ENGINE

(75) Inventor: Yuki Haba, Mishima (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 13/592,989

(22) Filed: Aug. 23, 2012

(65) Prior Publication Data

US 2013/0037632 A1 Feb. 14, 2013

Related U.S. Application Data

(62) Division of application No. 12/678,337, filed as application No. PCT/JP2008/066908 on Sep. 11, 2008, now abandoned.

(30) Foreign Application Priority Data

Sep. 20, 2007 (JP) ..... 2007-244123

(51) Int. Cl.
*F02M 41/16* (2006.01)

(52) U.S. Cl.
USPC ... 239/96; 239/533.8; 239/533.9; 239/533.12

(58) Field of Classification Search
CPC .... F02M 47/027; F02M 61/18; F02M 45/083
USPC ..... 239/96, 533.2–533.5, 533.7–533.12
See application file for complete search history.

(56) References Cited

U.S. PATENT DOCUMENTS

| | | | |
|---|---|---|---|
| 6,637,675 | B2 | 10/2003 | Carroll et al. |
| 7,066,400 | B2 | 6/2006 | Brenk et al. |
| 2007/0075160 | A1 | 4/2007 | Hongo et al. |

FOREIGN PATENT DOCUMENTS

| | | | |
|---|---|---|---|
| DE | 10 2006 000 268 | | 12/2006 |
| DE | 10 2006 035 412 | A1 | 5/2007 |
| DE | 10 2005 060 656 | | 6/2007 |
| DE | 10 2005 062 859 | | 7/2007 |
| EP | 1 519 032 | | 3/2005 |
| JP | 56-94857 | | 7/1981 |
| JP | 63-248966 | | 10/1988 |
| JP | 9-137764 | | 5/1997 |

(Continued)

OTHER PUBLICATIONS

Translation of the International Preliminary Report on Patentability including Written Opinion of the International Search Authority, dated Apr. 15, 2010, for PCT/JP2008/066908.

(Continued)

*Primary Examiner* — Christopher S. Kim
(74) *Attorney, Agent, or Firm* — Finnegan, Henderson, Farabow, Garrett & Dunner, LLP

(57) ABSTRACT

A tubular outer needle, slidably housed in a body, can communicate nozzle and suck chambers R1, R2 with each other and shut them from each other, and defines nozzle and suck chambers R1, R3. A rod-like inner needle, coaxially slidably housed in the outer needle, has a tip end portion movable into the suck chamber R2 at its lowermost position. In the range of small inner lift amount, an annular clearance is formed between an inner peripheral surface of an inner side wall defines the suck chamber R2 and an outer peripheral surface of an outer side wall of the needle tip end portion. Outer and inner lift amounts are regulated such that when fuel injection is started, the outer and inner lift amounts simultaneously increase from zero while when fuel injection is terminated, the inner lift amount returns to zero after the outer lift amount returns zero.

4 Claims, 16 Drawing Sheets

(56) References Cited

FOREIGN PATENT DOCUMENTS

| | | |
|---|---|---|
| JP | 2001-511231 | 8/2001 |
| JP | 2002-242798 | 8/2002 |
| JP | 2002-276509 | 9/2002 |
| JP | 2005-320870 | 11/2005 |
| JP | 2006-57471 | 3/2006 |
| JP | 2006-291195 A | 10/2006 |
| JP | 2007-132249 | 5/2007 |
| JP | 2007-218175 A | 8/2007 |
| WO | WO 2005/040594 | 5/2005 |
| WO | WO 2005/052352 | 6/2005 |

OTHER PUBLICATIONS

Extended European Search Report for EP Appl. No. 08832230.0 dated Mar. 4, 2011.

International Search Report for PCT/JP2008/066908 dated Nov. 4, 2008.

FUEL INJECTION CONTROL DEVICE OF ENGINE

CROSS-REFERENCE TO RELATED APPLICATIONS

This is a divisional of U.S. application Ser. No. 12/678,337, filed Mar. 16, 2010 now abandoned which is a national phase application of International Application No. PCT/JP2008/066908, filed Sep. 11, 2008, and which claims benefit to Japanese Patent Application No. 2007-244123, filed Sep. 20, 2007. Each of those applications is incorporated herein by reference.

TECHNICAL FIELD

The present invention relates to a fuel injection control device of an engine.

BACKGROUND ART

Conventionally, a fuel injection control device of an engine (in particular, a compression ignition engine) shown in FIG. 20 is known (for example, refer to Japanese Unexamined Patent Publication No. 2005-320870). In this device, in an interior of a body thereof, a needle 110 can communicate nozzle and suck chambers 120 and 130 with each other and shut them from each other, and defines the nozzle chamber 120 and a control chamber 140.

The nozzle chamber 120 is connected to a high pressure production part (having a fluid pressure pump and a common rail not shown) for producing a rail pressure Pc (high pressure) via a fuel supply passage 150. The suck chamber 130 is connected to a plurality of injection bores 160 facing a combustion chamber of the engine. The control chamber 140 is connected to the fuel supply passage 150 via a fuel inflow passage 170 and is connected to a fuel tank (not shown) via a fuel discharge passage 180. A control valve 190 for opening and closing the fuel discharge passage 180 is positioned in the fuel discharge passage 180.

The needle 110 is subject to a force by a pressure (the rail pressure Pc) in the nozzle chamber 120 in the opening direction (i.e. in the upward direction in FIG. 20) and is subject to a force by a pressure (a control pressure Ps) in the control chamber 140 and a spring force of a coil spring SP in the closing direction (i.e. in the downward direction in FIG. 20).

In this device, the control valve 190 is opened to open the needle 110 which is in a closed condition (i.e. a condition shown in FIG. 20, a lift amount=0) (i.e. to change the condition of the needle from the closed condition to an open condition (the lift amount>0)). Thereby, a fuel is discharged from the control chamber 140 to the fuel discharge passage 180, and then, the control pressure Ps decreases from the rail pressure Pc, and accordingly, the fuel flows into the control chamber 140 from the fuel supply passage 150 via the fuel inflow passage 170. As a result, the control pressure Ps decreases from the rail pressure Pc at a rate determined by a difference between outflow and inflow rates Qout and Qin (=Qout−Qin).

When the decreasing control pressure Ps reaches a "needle opening pressure" (i.e. the control pressure which may change the condition of the needle 110 from the closed condition to the open condition), the needle 110 opens (i.e. moves upwardly in FIG. 20), and as a result the fuel in the nozzle chamber 120 is injected from the injection bores 160 to the combustion chamber via the suck chamber 130. Thereafter, the needle 110 moves upwardly (i.e. moves in the upward direction in FIG. 20) against the spring force of the coil spring SP at a rate determined by a rate (=Qout−Qin) of decrease of the volume of the fuel in the control chamber 140. Accordingly, the fuel injection continues while the needle 110 is in the open condition.

On the other hand, the control valve 190 is closed to close the needle 110 which is in the open condition (i.e. to change the condition of the needle from the open condition to the closed condition). Thereby, the discharge of the fuel from the control chamber 140 via the fuel discharge passage 180 is ceased, while the flow of the fuel into the control chamber 140 via the fuel inflow passage 170 continues. As a result, the needle 110 moves downwardly (i.e. moves downwardly in FIG. 20) by means of the spring force of the coil spring SP at a rate determined by a rate (=Qin) of increase of the volume of the fuel in the control chamber 140. When the needle 110 is closed, the fuel injection is terminated. As explained here, the fuel injection is controlled by controlling the control valve 190 to control the control pressure Ps to regulate the lift amount of the needle 110.

DISCLOSURE OF THE INVENTION

As explained above, the device shown in FIG. 20 is constituted such that the needle 110 indirectly opens by communicating the nozzle and suck chambers 120 and 130 with each other and closes the injection bores 160 by shutting them from each other. Below, this constitution is referred to as "SMS type". On the other hand, as shown in FIG. 21 similar to FIG. 20, a device may be constituted such that the needle 110 directly opens and closes the injection bores 160. Below, this constitution is referred to as "VCO type". The SMS type has two advantages, compared with the VCO type.

First, in the VCO type, the needle directly opens and closes the injection bores, and therefore when the needle is decentered, a difference in the substantial opening area between the injection bores may occur, in particular, in a region wherein the lift amount of the needle is extremely small. Thereby, phenomena that fuel does not flow out from a part of the injection bores or fuel may flow out from the injection bores while the fuel swirls in the injection bores to form a so-called hollow cone fuel spray or the like, may occur. As a result, the injected fuel is unlikely to be diffused and a chance of the injected fuel to meet oxygen in the combustion chamber decreases, and therefore problems that the amount of the production of the smoke increases and the output of the engine decreases, easily occur. On the other hand, in the SMS type, the needle indirectly opens and closes the injection bores via the suck chamber, and therefore even when the needle is decentered, the above-mentioned difference in the substantial opening area between the injection bores may not occur. Accordingly, the problems such as the above-mentioned increase of the amount of the production of the smoke and the above-mentioned decrease of the output of the engine due to the above-mentioned difference in the substantial opening areas, may not occur.

Second, in the VCO type, the change of the flow direction when the fuel flows into the injection bores from the nozzle chamber is large, and therefore a fluid separation area is easily formed adjacent to the inlets of the injection bores. As a result, the flow rate of the fuel flowing through the injection bores becomes small (in other words, the flow coefficient in the injection bores becomes small), and therefore the penetration of the fuel spray is weakened. Thereby, the injected fuel is unlikely to be diffused and therefore the chance of the injected fuel to meet the oxygen in the combustion chamber decreases, and accordingly problems that the amount of the production of the smoke increases and the output of the engine decreases, easily occur. On the other hand, in the SMS type, the change of the flow direction of the fuel when the fuel flows into the injection bores from the suck chamber, is small. As a result, the flow coefficient in the injection bores becomes large, and the fuel spray sufficiently atomized and having a strong penetration may be formed. As a result, the chance of the injected fuel to meet the oxygen in the combustion chamber increases, and therefore the increase of the amount of the production of the smock can be restricted and the output of the engine can be increased.

Generally, at the small engine load, the temperature (the compression end temperature) in the combustion chamber is low. Accordingly, when the fuel spray is excessively atomized by the strong penetration (so-called overlean), the incomplete combustion tends to occur, and therefore the amount of the discharge of the unburned hydrocarbon tends to increase. On the other hand, at the middle or large engine load, the compression end temperature in the combustion chamber is sufficiently high, and therefore even when the fuel spray having a strong penetration is formed, it is unlikely that the problem that the amount of the discharge of the unburned hydrocarbon is increased due to the overlean, occurs. Accordingly, in particular, at the middle or large engine load, the SMS type wherein the fuel spray having a strong penetration can be formed, is advantageous. As explained here, the SMS type has the above-explained two advantages, compared with the VCO type.

However, in the SMS type, after the needle is closed, fuel remains in the suck chamber (in other words, in the dead volume), and therefore the SMS type has a drawback that a phenomenon (hereinafter, "post drip of the fuel") that the remaining fuel flows out to the combustion chamber via the injection bores at the combustion stroke, may occur. The occurrence of the post drip of the fuel leads to the increase of the amount of the discharge of the unburned hydrocarbon. It should be noted that in the VCO type, the needle directly closes the injection bores, and therefore the post drip of the fuel does not occur.

In consideration of the above circumstances, the object of the present invention is to provide an SMS type fuel injection control device wherein the post drip of the fuel can be restricted. In other words, the object of the present invention is to provide an SMS type fuel injection control device having the advantage of the VCO type (the post drip of the fuel does not occur).

The basic constitution of the SMS type fuel injection control device according to the invention is similar to that of the above-explained device shown in FIG. 20. The features of the device are as follows.

First, a needle is constituted by outer and inner needles. The outer needle is a cylindrical needle axially movably housed in an interior of a body. The outer needle shuts a suck chamber from a nozzle chamber in a closed condition that a seat portion provided in a tip end portion of the outer needle at the one end side thereof and a valve seated portion formed in the body and opposing to the seat portion abut to each other, while the outer needle communicates the suck and nozzle chambers with each other in an open condition that the outer needle moves from the closed condition to the other end side of the outer needle such that the seat and valve seated portions moves apart from each other. Accordingly, the outer needle has the same function as that of the above-mentioned needle 110 shown in FIG. 20.

The inner needle is a (rod-like and/or solid) needle housed in an interior of the outer needle such that the inner needle can slide axially (in a fluid-tight manner) relative to the outer needle in the interior thereof. The inner needle may be positioned and constituted such that the tip end portion of the inner needle at the one end side thereof may or may not move (project) into the suck chamber at the lowermost position corresponding to the most one end side position within the range of the possible movement of the inner needle relative to the body. The tip end portion of the inner needle at the one end side thereof, faces the suck chamber.

An outer lift amount corresponding to the movement amount of the outer needle from the closed condition to the other end side thereof, is regulated by outer lift amount regulating means. An inner lift amount corresponding to the movement amount of the inner needle from the lowermost position to the other end side thereof, is regulated by inner lift amount regulating means.

The outer and inner lift amount regulating means is constituted to regulate the outer and inner lift amounts such that when the fuel injection is started, the outer and inner lift amounts both increase simultaneously from zero, or one of the outer and inner lift amounts increases from zero prior to the increase of the other lift amount from zero, while when the fuel injection is terminated, the outer and inner lift amounts decrease and after the outer lift amount returns to zero, the inner lift amount returns to zero.

According to the above-mentioned constitution, the tip end portion of the inner needle at the one end side thereof facing the suck chamber, faces the suck chamber. In addition, when the fuel injection is terminated, after the outer lift amount returns to zero, the inner lift amount decreases and returns to zero (hereinafter, referred to as "outer needle first closing"). Accordingly, after the outer needle is closed, and therefore the supply of the fuel from the nozzle chamber to the suck chamber is shut, the volume of the suck chamber is decreased by the downward movement of the inner needle.

Accordingly, after the outer needle is closed, the fuel remaining in the suck chamber (in other words, in the dead volume), is immediately pushed to the combustion chamber via the injection bores by the downward movement of the inner needle. In addition, even when a small dead volume still remains in the suck chamber in the condition that the inner needle reaches the lowermost position, all fuel remaining in the small dead volume can move into the combustion chamber via the injection bores by means of the inertia of the flow of the fuel already formed until the inner needle reaches the lowermost position. As explained above, according to the above-explained constitution, the inner needle has a function to push the fuel remaining in the suck chamber by the "outer needle first closing", and therefore the "post drip of the fuel" in the SMS type fuel injection control device, can be restricted.

The above-mentioned outer lift amount regulating means, for example, similar to the device shown in FIG. 20, may be constituted such that the means drives the outer needle in the other end side direction (the lift amount increase direction) by the pressure (the rail pressure) in the nozzle chamber, and such that the means drives the outer needle in the one end side direction (the lift amount decrease direction) by the pressure (the control pressure) in a control chamber provided at the other end side of the outer needle and an outer coil spring provided at the other end side of the outer needle.

The above-mentioned inner lift amount regulating means, for example, may be constituted such that the means drives the inner needle in the other end side direction (the lift amount increase direction) by a first engagement mechanism explained below, and such that the means drives the inner needle in the one end side direction (the lift amount decrease direction) by the pressure (control pressure) in the control chamber provided at the other end side of the inner needle and an inner spring (or a second engagement mechanism explained below) provided at the other end side of the inner needle.

For example, in the case that a common (single) control chamber is provided at the other end sides of the outer and inner needles and outer and inner coil springs both are provided, in order to accomplish the "outer needle first closing", for example, it can be considered that the spring force of the outer coil spring is set to a value larger than that of the inner coil spring.

In this case, the outer and inner lift amount regulating means, concretely, has a control chamber provided at the other end sides of the outer and inner needles, the other ends of the outer and inner needles being subject to a force in the one end side direction by a control pressure corresponding to the pressure of the fuel in the control chamber, a high pressure production part for producing the fuel having the rail pressure, a fuel supply passage for connecting the high pressure production part and the nozzle chamber to each other, a fuel inflow passage for connecting the fuel supply passage and the control chamber, a fuel discharge passage for connecting the control chamber and a fuel tank, and a control valve positioned in the fuel discharge passage for opening and closing the fuel discharge passage.

Preferably, the above-mentioned fuel injection control device according to the invention further comprises throttle portion formation means for forming a throttle portion to throttle a part of a fuel flow path formed in the suck chamber from the nozzle chamber to the injection bores in the open condition of the outer needle only when the inner lift amount is between zero and a first predetermined amount larger than zero, and the outer and inner lift amount regulating means is constituted to regulate the outer and inner lift amounts such that when the fuel injection is started, the outer and inner lift amounts both simultaneously increase from zero, or the outer lift amount increases from zero prior to the increase of the inner lift amount from zero. Below, the "increase of the outer lift amount from zero prior to or simultaneously to the increase of the inner lift amount from zero" is referred to as "outer needle first opening".

As explained above, since the temperature (the compression end temperature) in the combustion chamber is low at the small engine load, when the penetration of the fuel spray is strong, the amount of the discharge of the unburned hydrocarbon easily increases due to the overlean. Accordingly, at the small engine load, it is requested to restrict the increase of the amount of the discharge of the unburned hydrocarbon due to the overlean by weakening the penetration of the fuel spray. In addition, since the period of the opening of the outer needle (the period that the open condition is maintained) is short at the small engine load, the outer lift amount changes only within a narrow range adjacent to zero. Accordingly, it is preferred that when the outer lift amount is small after the outer needle is opened, the increase of the amount of the discharge of the unburned hydrocarbon due to the overlean is restricted by forming the fuel spray having a weak penetration, and after the outer lift amount increases, as explained above, the increase of the amount of the production of the smoke is restricted and the engine output is increased by forming the fuel spray having a strong penetration.

The above-explained constitution is based on the above-mentioned circumstances. That is, according to the constitution, the inner lift amount is between zero and the first predetermined amount by the "outer needle first opening" when the outer lift amount is small after the outer needle is opened, and therefore the above-mentioned throttle portion can be formed in the suck chamber. Since the flow rate of the fuel flowing through the suck chamber (accordingly, flowing through the injection bores) is restricted by the formation of the throttle portion, the penetration of the fuel spray is weakened. On the other hand, after the outer lift amount becomes large, the inner lift amount exceeds the first predetermined amount, and therefore the above-mentioned throttle portion is disappeared. As a result, the original property of the above-mentioned SMS type itself functions, and therefore the fuel spray having a strong penetration is formed.

That is, according to the above-explained constitution, the inner needle has a function to form the throttle portion in the suck chamber by the "outer needle first opening" only when the outer lift amount is small, and therefore at the small engine load, the increase of the amount of the discharge of the unburned hydrocarbon due to the overlean can be restricted by weakening the penetration of the fuel spray, while at the middle or large engine load, the increase of the amount of the production of the smoke can be restricted and the engine output can be increased by forming a fuel spray having a strong penetration. In addition, the inner needle has a function to push out the fuel remaining in the suck chamber by the "outer needle first closing" after the outer needle is closed, and therefore the increase of the amount of the discharge of the unburned hydrocarbon due to the "post drip of the fuel" can be restricted by restricting the "post drip of the fuel".

As the above-mentioned throttle portion, for example, an annular clearance formed by an outer peripheral surface of an outer side wall of the tip end portion of the inner needle at the one end side thereof opposing to an inner peripheral surface of an inner side wall defining the suck chamber when the inner lift amount is between zero and the first predetermined amount, may be used.

Preferably, in the above-explained fuel injection control device according to the invention, the outer and inner lift amount regulating means has a first engagement mechanism constituted by first engagement portions of the outer and inner needles for forbidding that the inner lift amount becomes smaller than the outer lift amount by the contact of the first engagement portions of the outer and inner needles to each other. In addition, preferably, the outer and inner lift amount regulating means is constituted to regulate the outer and inner lift amounts such that when the fuel injection is started, the inner lift amount simultaneously increases from zero by the action of the first engagement mechanism in response to the increase of the outer lift amount from zero.

Thereby, it is ensured that the inner needle starts moving from the lowermost position at the same time as the opening of the outer needle (i.e. the "outer needle first opening") by the action of the first engagement mechanism. As a result, the variability of the outer lift amount can be reduced when the above-mentioned throttle portion is disappeared by the inner lift amount exceeding the first predetermined amount, and therefore the fuel injection ratio (the fuel injection property) relative to the outer lift amount can be stabilized.

In this case, preferably, the first engagement mechanism is constituted by a stepped surface extending perpendicularly to the axial direction and formed in the inner side wall of the outer needle as the first engagement portion of the outer needle, and a stepped surface extending (generally) perpendicularly to the axial direction and formed in the outer side wall of the inner needle as the first engagement portion of the inner needle.

For example, in the case that the control chamber is provided at the other end sides of the outer and inner needles, in the closed condition of the outer needle, the fuel in the control chamber at the control pressure (=the rail pressure (high pressure)) may leak to the suck chamber via a clearance between the sliding portions of the outer and inner needles (the portion of the inner side wall of the outer needle and the portion of the outer side wall of the inner needle opposed to each other), and as a result, the leaked fuel may leak to the combustion chamber via the injection bores. On the other hand, according to the above-explained constitution, in the closed condition of the outer needle, the stepped surfaces of the outer and inner needles are contacted and pressed to each other by the force exerted on the inner needle by the control pressure (=the rail pressure) in the one end side direction (the lift amount decrease direction). As a result, a seal portion is formed in the contact part between the stepped surfaces, and therefore the leakage of the fuel from the control chamber to the suck chamber via the above-mentioned clearance between the sliding portions of the outer and inner needles, can be restricted.

Preferably, in the above-explained fuel injection control device according to the invention, the outer and inner lift amount regulating means has a second engagement mechanism constituted by second engagement portions of the outer and inner needles for forbidding that the inner lift amount becomes larger than an amount larger than the outer lift amount by a second predetermined amount larger than zero by the contact of the second engagement portions of the outer and inner needles to each other. In addition, preferably, the outer and inner lift amount regulating means is constituted to regulate the outer and inner lift amounts such that when the fuel injection is terminated, in response to the decrease of the outer lift amount, by the action of the second engagement mechanism, the inner lift amount decreases while the inner lift amount is maintained at the amount larger than the outer lift amount by the second predetermined amount, and after the outer lift amount returns to zero, the inner lift amount returns from the second predetermined amount to zero.

Thereby, the second engagement mechanism may be used as a mechanism for driving the inner needle in the one end side direction (the lift amount decrease direction), and therefore it is not necessary to provide an inner spring. After the outer needle is closed, the pressure in the control chamber is maintained at the rail pressure (high pressure), while the pressure in the suck chamber decreases. By the difference in the pressure therebetween, the inner needle is driven in the one end side direction, and therefore even when the inner spring is not provided, the inner lift amount returns from the second predetermined amount to zero.

According to the above-explained constitution, the "outer needle first closing" can be accomplished by the action of the second engagement mechanism even when the inner spring is not provided. As a result, in order to accomplish the "outer needle first closing", an outer spring having a large spring force is not needed, and therefore, a small outer spring can be employed.

In the above-explained fuel injection control device according to the invention, for example, independent control chambers may be provided at the other end sides of the outer and inner needles, respectively. In this case, the outer and inner lift amount regulating means may have an outer control chamber provided at the other end side of the outer needle, the other end of the outer needle being subject to a force in the one end side direction by an outer control pressure corresponding to the pressure of the fuel in the outer control chamber, an inner control chamber provided at the other end side of the inner needle independently of the outer control chamber, the other end of the inner needle being subject to a force in the one end side direction by an inner control pressure corresponding to the pressure of the fuel in the inner control chamber, a high pressure production part for producing the fuel having the rail pressure, a fuel supply passage for connecting the high pressure production part and the nozzle chamber to each other, an outer fuel inflow passage for connecting the fuel supply passage and the outer control chamber to each other, an inner fuel inflow passage for connecting the fuel supply passage and the inner control chamber to each other, an outer fuel outflow passage connected to the outer control chamber at its upstream end, an inner fuel outflow passage connected to the inner control chamber at its upstream end, the downstream end of the inner fuel outflow passage converging to the downstream end of the outer fuel outflow passage, a fuel discharge passage for connecting the converging portion of the outer and inner fuel outflow passages and a fuel tank to each other, and a control valve positioned in the fuel discharge passage for opening and closing the fuel discharge passage.

As explained above, by providing the outer and inner needles with the control chambers (the outer and inner control chambers), independently, the outer and inner control pressures can be independently controlled. Therefore, for example, by regulating opening areas of orifices positioned in the outer and inner fuel inflow passages and the outer and inner fuel outflow passages, respectively, after the control valve is opened, the decreasing outer and inner control pressures can be changed while the outer control pressure is maintained lower than the inner control pressure. Thereby, the "outer needle first opening" can be easily accomplished.

In addition, by regulating the opening areas of the orifices positioned in the outer and inner fuel inflow passages and the outer and inner fuel outflow passages, respectively, after the control valve is closed, the increasing outer and inner control pressures can be changed while the outer control pressure is maintained higher than the inner control pressure. Thereby, the "outer needle first closing" can be easily accomplished. In other words, even when an outer spring having a small spring force is employed, the "outer needle first closing" can be accomplished. As a result, an outer spring having a small spring force can be employed.

As explained above, in the case that the independent control chambers are provided at the other end sides of the outer and inner needles, respectively, an on-off valve may be positioned in the inner fuel inflow passage for opening the inner fuel inflow passage when the rail pressure is lower than or equal to a predetermined pressure and closing the inner fuel inflow passage when the rail pressure exceeds the predetermined pressure, and the outer and inner lift amount regulating means may be constituted to regulate the outer and inner lift amounts such that at the start of the fuel injection, when the rail pressure exceeds the predetermined pressure, the inner lift amount increases from zero prior to the increase of the outer lift amount from zero.

Thereby, for example, in the case that the rail pressure is changed depending on the engine load and engine speed or the like, when the rail pressure is low (generally, at the small engine load), the on-off valve is opened, and therefore the inner fuel inflow passage is opened. As a result, after the control valve is opened, the decrease of the inner control pressure is slow. Accordingly, by regulating the opening areas of the orifices positioned in the outer and inner fuel inflow passages and the outer and inner fuel outflow passages, respectively, the outer control pressure can be changed while the outer control pressure is maintained lower than the inner control pressure. Thereby, the "outer needle first opening" can be accomplished. Accordingly, at the small engine load, the increase of the amount of the discharge of the unburned hydrocarbon due to the overlean can be restricted by weakening the penetration of the fuel spray as explained above.

On the other hand, when the rail pressure is high (generally, at the middle or large engine load), the on-off valve is closed, and therefore the inner fuel inflow passage is closed. As a result, after the control valve is opened, the decrease of the inner control pressure is rapid. Accordingly, by regulating the opening areas of the orifices positioned in the outer and inner fuel inflow passages and the outer and inner fuel outflow passages, respectively, the inner control pressure can be changed while the inner control pressure is maintained lower than the outer control pressure. Thereby, it can be accomplished that "the inner lift amount increases from zero prior to the increase of the outer lift amount from zero" (hereinafter, referred to as "inner needle first opening").

As a result, before the outer needle is opened, by the inner lift amount exceeding a first predetermined amount, the above-mentioned throttle portion can be disappeared. Accordingly, after the outer needle is opened, the condition that there is no throttle portion can be obtained at the beginning, and therefore immediately after the outer needle is opened, the original property of the above-mentioned SMS itself functions, and therefore the fuel spray having a strong penetration can be formed. Accordingly, at the middle or large engine load, the "inner needle first opening" is accomplished, and therefore the increase of the amount of the production of the smoke can be further restricted and the output of the engine can be further increased, compared with the case that the "outer needle first opening" is accomplished.

BEST MODE FOR CARRYING OUT THE INVENTION

Figure 1:
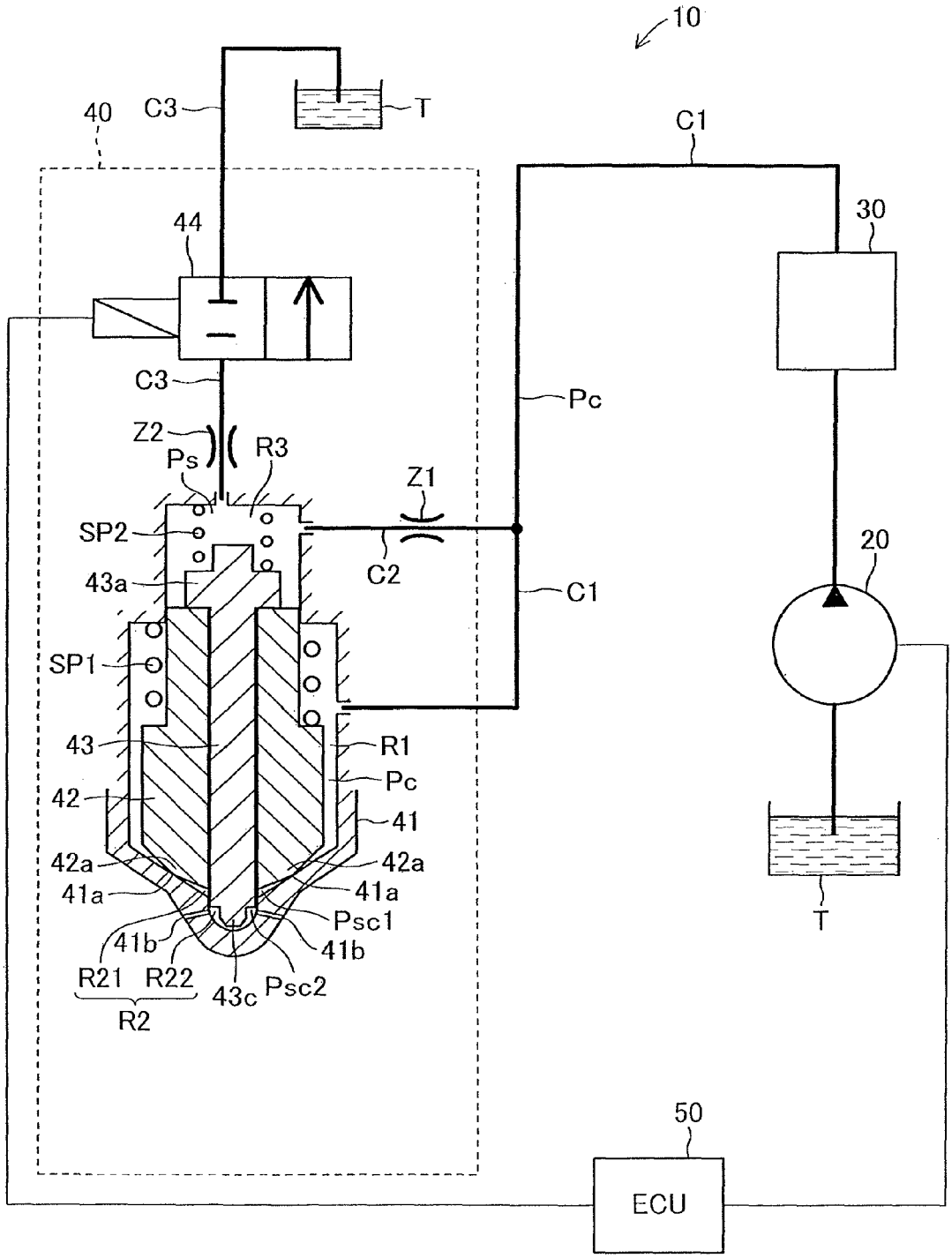
FIG. 1 is a schematic configuration view of the entire of a fuel injection control device of the first embodiment according to the invention.

Below, each embodiment of a SMS type fuel injection control device of an engine according to the invention will be explained, referring to the drawings.

First Embodiment

FIG. 1 shows a schematic configuration of the entire of a fuel injection control device 10 of an engine (a compression ignition engine) of the first embodiment according to the invention. The fuel injection control device 10 comprises a fuel pump 20 for sucking fuel stored in a fuel tank T thereinto and discharging the same therefrom, a common rail 30 supplied with the fuel discharged by the fuel pump 20 at a high pressure, a fuel injector 40 supplied with the fuel from the common rail 30 via a fuel supply passage C1 at a high pressure for injecting the fuel into a combustion chamber (not shown) of the engine, and an electronic control unit 50 for controlling the fuel pump 20 and the injector 40. The fuel pump 20 and the common rail 30 correspond to the above-mentioned "high pressure production part".

It should be noted that one injector 40 supplied with the fuel from the common rail 30 via one fuel supply passage C1, is shown in FIG. 1, however, in fact, the injector 40 and the fuel supply passage C1 are provided relative to each of a plurality of combustion chambers of the engine, and each injector 40 is individually connected to the common rail 30 via the corresponding fuel supply passage C1. The pressure (hereinafter, referred to as "rail pressure Pc") of the fuel in the fuel supply passage C1 is generally equal to the pressure of the fuel in the common rail 30. Below, as a matter of convenience relating to the explanation, the upper and lower sides in the papers of the drawings may be referred to as "upper side" and "lower side", respectively. Further, in the papers of the drawings, the movement in the upward direction (the above-mentioned other end side direction) may be referred to as "upward movement" and the movement in the downward direction (the above-mentioned one end side direction) may be referred to as "downward movement".

The fuel pump 20 is constituted to be able to regulate the amount of the suck of the fuel according to the instructions from the ECU 50. Thereby, the pressure of the discharge of the fuel (therefore, the rail pressure Pc) can be regulated. The rail pressure Pc is, for example, determined and regulated on the basis of the engine load (the output torque) or the engine speed or the like.

The injector 40 generally comprises a body 41, an outer needle 42, an inner needle 43, and a control valve 44. The outer needle 42 has a tubular shape and is housed in the interior of the body 41 to be able to slide relative to the body 41 in an axial (up-down) direction. The inner needle 43 has an elongated cylindrical shape (a rod-like shape) and is coaxially housed in an interior (the cylindrical space) of the outer needle 42 to be able to slide relative to the outer needle 42 in the axial (up-down) direction.

An annular seat portion 42*a* is provided in the lower tip end portion of the outer needle 42, and the seat portion 42*a* and an annular valve seated portion 41*a* of the body 41 can abut to and move apart from each other, depending on a position of the outer needle 42 in the up-down direction. The outer needle 42 shuts the communication between a nozzle chamber R1 and a suck chamber R2 (constituted by upstream and downstream suck chambers R21 and R22 explained below) in the condition (shown in FIG. 1, and hereinafter referred to as "closed condition") that the seat portion 42*a* abuts to the valve seated portion 41*a*. The outer needle 42 communicates the nozzle chamber R1 with the suck chamber R2 in the condition (hereinafter referred to as "open condition") that the outer needle moves upwardly from the closed condition and the seat portion 42*a* is apart from the valve seated portion 41*a*. In addition, the outer and inner needles 42 and 43 constantly define the nozzle chamber R1 and a control chamber R3.

The nozzle chamber R1 is connected to the fuel supply passage C1 and stores the fuel at the rail pressure Pc. The suck chamber R2 (in particular, the downstream suck chamber R22) is connected to a plurality of injection bores 41*b* provided in the lower tip of the body 41 and facing the combustion chamber of the engine. The control chamber R3 is connected to the fuel supply passage C1 via a fuel inflow passage C2 wherein an orifice Z1 is positioned, and is connected to the fuel tank T via a fuel discharge passage C3 wherein an orifice Z2 is positioned.

The control valve 44 is a 2-port 2-position on-off valve, and is positioned in the fuel discharge passage C3 so as to open and close the fuel discharge passage C3 according to the instructions from the ECU 50.

The outer needle 42 is subject to an upward force by the pressure (the rail pressure Pc) in the nozzle chamber R1 and the pressure (the upstream suck pressure Psc1) in the suck chamber R2 (in particular, the upstream suck chamber R21), and is subject to a downward force by the pressure (the control pressure Ps) in the control chamber R3 and a spring force of a coil spring SP1 positioned in the nozzle chamber R1. The inner needle 43 is subject to an upward force by the pressure (the downstream suck pressure Psc2) in the suck chamber R2 (in particular, the downstream suck chamber R22) and is subject to a downward force by the pressure (the control pressure Ps) in the control chamber R3 and a spring force of a coil spring SP2 positioned in the control chamber R3.

The inner needle 43 has a lowermost position in the condition (shown in FIG. 1) wherein the outer needle 42 is in the closed condition and a lower end surface of a ring-like flange portion 43*a* formed in the upper end portion of the inner needle 43, abuts to the upper end surface of the outer needle 42. Below, the amount (the elevation amount) of the upward movement of the outer needle 42 from the closed condition is referred to as "outer lift amount", and the amount (the elevation amount) of the upward movement of the inner needle 43 from the lowermost position is referred to as "inner lift amount". Accordingly, FIG. 1 shows the condition of the outer lift amount=the inner lift amount=0. Further, it is prevented that the inner lift amount becomes smaller than the outer lift amount by the contact of the lower end surface of the flange portion 43*a* of the inner needle 43 and the upper end surface of the outer needle 42 to each other.

Figure 2:
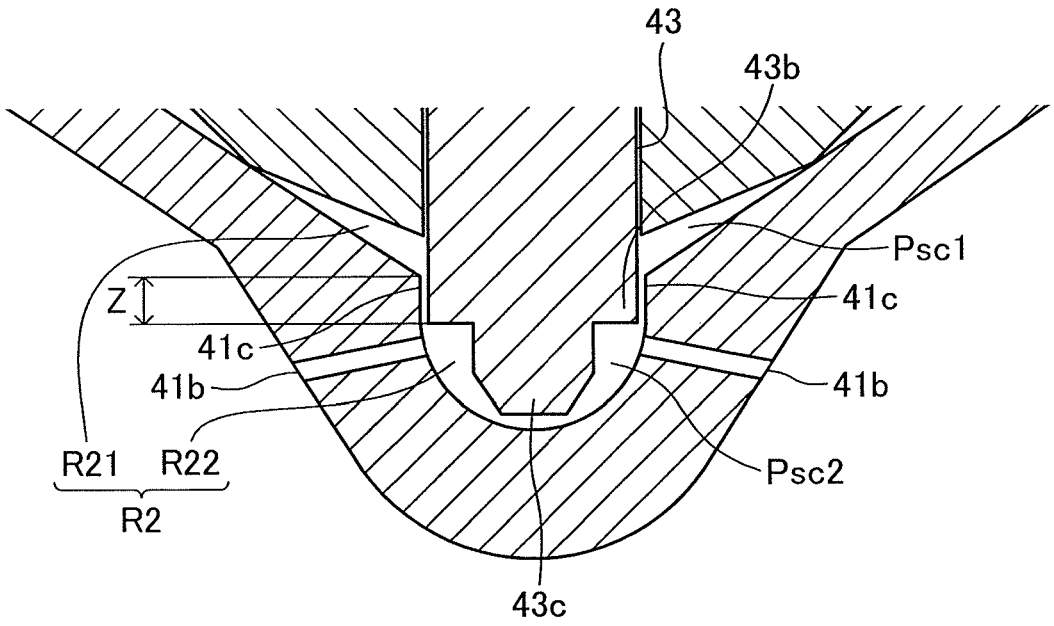
FIG. 2 is an enlarged view of a suck chamber and the surroundings thereof of the device shown in FIG. 1.

Below, the suck chamber R2 and the surroundings thereof will be explained, referring to FIG. 2, which shows an enlarged view of FIG. 1. Similar to FIG. 1, FIG. 2 shows the condition of the outer lift amount=the inner lift amount=0. As shown in FIG. 2, in the condition of the inner lift amount=0, the cylindrical lower tip end portion 43*b* of the inner needle 43 moves (projects) into the suck chamber R2. A convex portion 43*c* projecting downwardly is formed in the lower end of the inner needle 43. Accordingly, in the condition of the inner lift amount=0, only extreme small dead volume remains in the suck chamber R2.

In the condition of the inner lift amount=0, the cylindrical outer surface (the outer peripheral surface) of the outer side wall of the tip end portion 43*b* is opposed to the cylindrical inner surface (inner peripheral surface) of the inner side wall defining the suck chamber R2 over the length Z (the above-mentioned first predetermined amount) in the axial (up-down) direction. As a result, only within the range of the inner lift amount between 0 and Z, an annular clearance (an annular throttle) is formed in the suck chamber R2 at a part of the fuel flow passage (along the way) from the nozzle chamber R1 to the injection bores 41*b*. The annular throttle disappears when the inner lift amount becomes larger than Z.

In particular, the portion (the upper portion or the upstream portion) in the suck chamber R2 at the side of the nozzle chamber R1 relative to the annular throttle, is referred to as upstream suck chamber R21 and the portion (the lower portion or the downstream portion) in the suck chamber R2 at the side of the injection bores 41*b* relative to the annular throttle, is referred to as downstream suck chamber R22. The pressures in the upstream and downstream suck chambers R21 and R22 are referred to as "upstream suck pressure Psc1" and "downstream suck pressure Psc2", respectively.

Next, the operation of the fuel injection control device 10 constituted as explained above will be explained, referring to FIGS. 3-5. In the condition of the outer lift amount=the inner lift amount=0 as shown in FIG. 1, when the control valve 44 is opened according to the instructions from ECU 50, the fuel is discharged from the control chamber R3 to the fuel tank T via the fuel discharge passage C3.

As a result, the control pressure Ps decreases from the rail pressure Pc. Accordingly, the fuel flows into the control chamber R3 from the fuel supply passage C1 via fuel inflow passage C2. As a result, the control pressure Ps decreases from the rail pressure Pc at a rate determined by the difference between the outflow rate of the fuel determined by the opening area of the orifice Z2 positioned in the fuel discharge passage C3 and the inflow rate of the fuel determined by the opening area of the orifice Z1 positioned in the fuel inflow passage C2.

Figure 3:
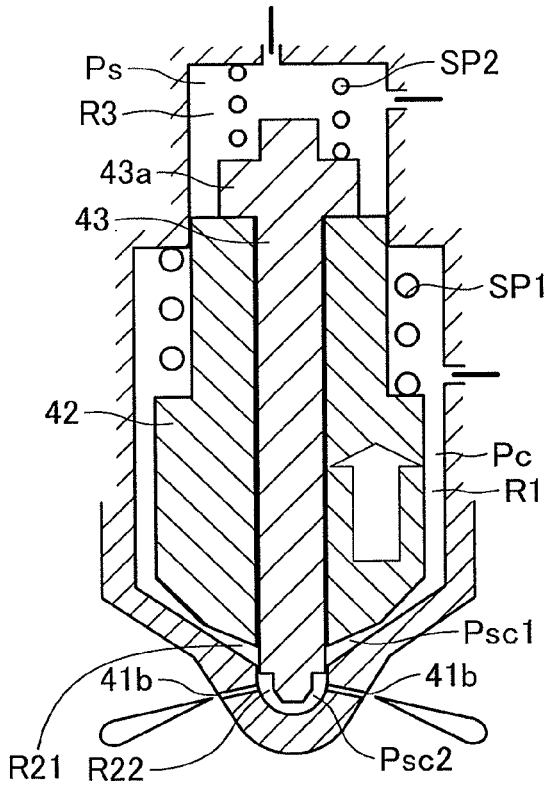
FIG. 3 is a view showing the condition of the outer and inner needles immediately after a fuel injection starts in the device shown in FIG. 1.

When the decreasing control pressure Ps reaches a predetermined valve open pressure of the outer needle 42, the outer needle 42 is opened (the outer lift amount starts increasing from 0) as shown in FIG. 3. As a result, the fuel injection of the fuel in the nozzle chamber R2 from the injection bores 41*b* to the combustion chamber via the suck chamber R2 (concretely, the upstream suck chamber R21→the downstream suck chamber R22) starts. It should be noted that in the condition that the outer needle 42 is closed, the upstream and downstream pressures Psc1 and Psc2 are sufficiently low (generally equal to the pressure in the combustion chamber), compared with the rail pressure Pc, and the upward force exerting on the inner needle 43 by the downstream suck pressure Psc2 is extremely small, compared with the downward force on the inner needle 43 by the control pressure Ps. Accordingly, the inner needle 43 does not start moving upwardly prior to the start of the upward movement of the outer needle 42 (in other words, the above-mentioned "inner needle first opening" does not occur.).

Along with the opening of the outer needle 42, the inner needle 42 starts moving upwardly (the inner lift amount starts increasing from 0) by the lower end surface of the flange portion 43*a* of the inner needle 43 being pressed by the upper end surface of the outer needle 42. As explained here, the above-mentioned "outer needle first opening" is accomplished by means of the lower end surface of the flange portion 43*a* of the inner needle 43 being pressed by the upper end surface of the outer needle 42.

After the outer needle 42 is opened, the outer needle 42 moves upwardly against the spring force of the coil spring SP1 at a rate determined by a rate of the decrease of the volume of the fuel in the control chamber R3 (=the outflow rate−the inflow rate). Accordingly, the inner needle 43 moves upwardly along with the outer needle 42 against the spring force of the coil spring SP2 (the outer and inner lift amounts increase while the amounts are maintained equal to each other.) by the lower end surface of the flange portion 43*a* of the inner needle 43 being continuously pressed by the upper end surface of the outer needle 42.

Figure 6:
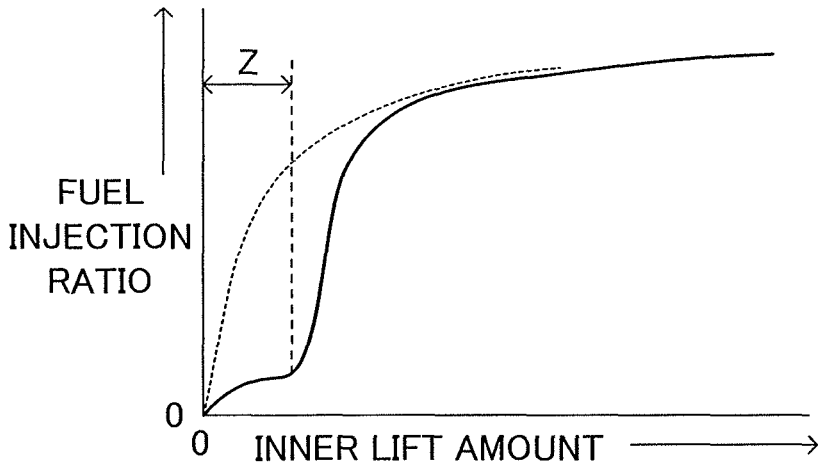
FIG. 6 is a graph showing the relationship between an inner lift amount and a fuel injection ratio in the case that the device shown in FIG. 1 is applied.

As shown in FIG. 3, within the range between 0 and Z wherein the outer and inner lift amounts are small, the above-mentioned "annular throttle" is formed in the suck chamber R3. Accordingly, the flow rate of the fuel flowing through the suck chamber R2 (accordingly, flowing through the injection bores 41*b*) is restricted. As a result, as shown in FIG. 6, in the stage before the inner lift amount (=the outer lift amount) reaches Z (i.e. the initial fuel injection stage), the fuel injection ratio is restricted to a small ratio, and the penetration of the fuel spray is weakened. It should be noted that when the outer and inner lift amounts are within the range between 0 and Z, the upstream suck pressure Psc1 may increase adjacent to the rail pressure Pc, while the downstream suck pressure Psc2 is maintained at a pressure lower than the upstream suck pressure Psc1 by the decrease of the pressure generated by the "annular throttle".

Figure 4:
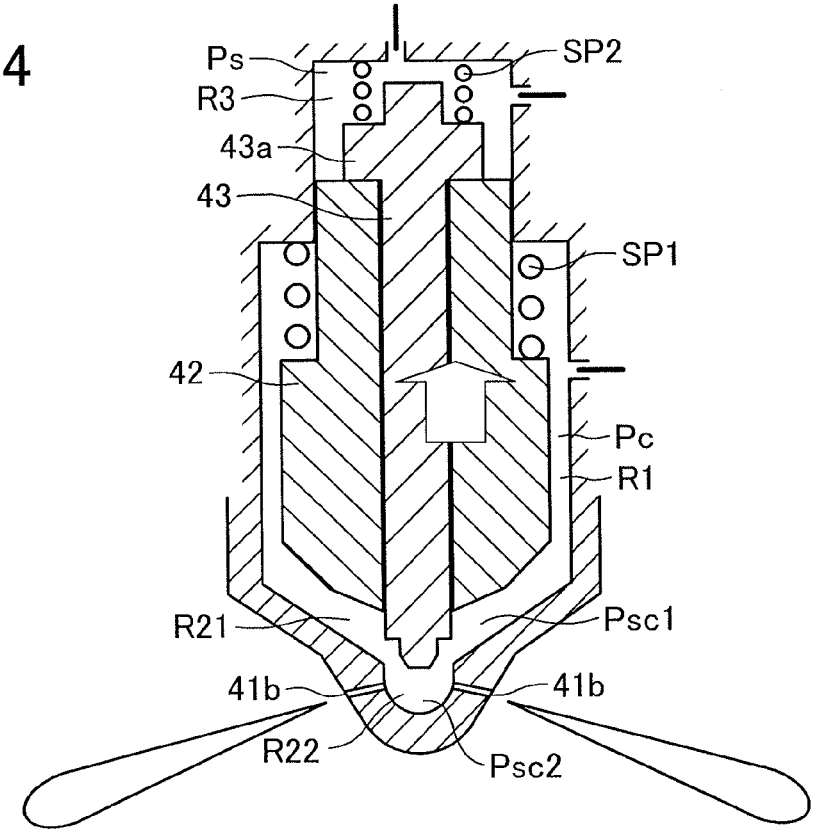
FIG. 4 is a view showing the condition of the outer and inner needles when the needles sufficiently move upwardly in the device shown in FIG. 1.

As shown in FIG. 4, when the continuously increasing outer and inner lift amounts exceed Z, the "annular throttle" disappears. Accordingly, the restriction of the flow rate of the fuel flowing through the suck chamber R2 is released. As a result, as shown in FIG. 6, the original property of the SMS type itself functions, and therefore the fuel spray having a strong penetration and a large fuel injection ratio is formed. It should be noted that once the outer and inner lift amounts exceed Z, the decrease of the pressure due to the above-mentioned "annular throttle" does not occur, and therefore the upstream and downstream pressures Psc1 and Psc2 both become generally equal to the rail pressure Pc.

Next, the case that the control valve 44 is closed from the above condition according to the instructions from the ECU 50, will be explained. In this case, the fuel discharge passage C3 is shut, and therefore the discharge of the fuel from the control chamber R3 is ceased. On the other hand, the inflow of the fuel into the control chamber R3 via the fuel inflow passage C2 still continues. As a result, the continuously decreasing control pressure Ps increases in reverse.

In addition, the spring force of the coil spring SP1 is set to a value sufficiently larger than the spring force of the coil spring SP2. As a result, the outer needle 42 starts moving downwardly prior to the start of the downward movement of the inner needle 43. In other words, the outer and inner lift amounts which have been maintained at the same value, both decrease while the outer lift amount is maintained smaller than the inner lift amount.

Figure 5:
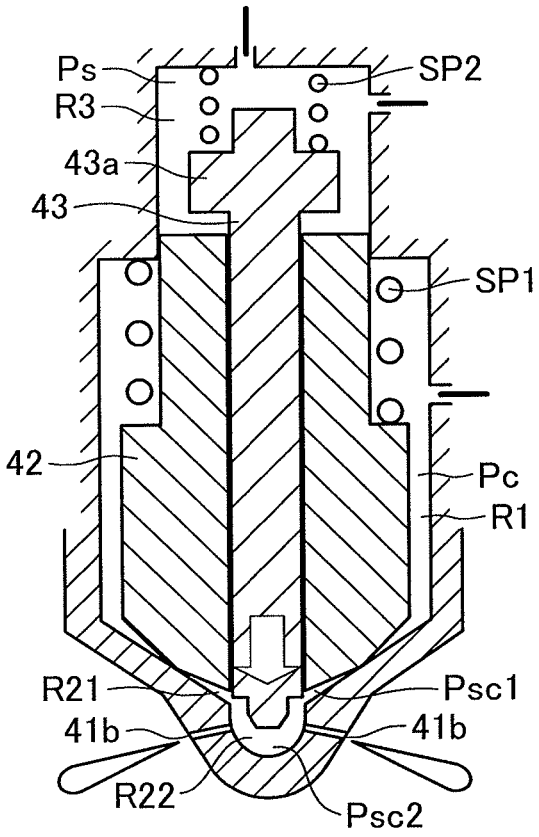
FIG. 5 is a view showing the condition of the outer and inner needles immediately before the fuel injection is terminated in the device shown in FIG. 1.

As shown in FIG. 5, when the outer needle 42 is closed (the outer lift amount=0), the supply of the fuel from the nozzle chamber R1 to the suck chamber R2 is shut, and therefore the fuel injection is terminated. At this stage, the inner needle 43 has not reached the lowermost position (the inner lift amount=0) (refer to FIG. 5). It should be noted that when the outer needle 42 is closed, the upstream and downstream suck pressures Psc1 and Psc2 again decrease to the sufficient small values (generally equal to the pressure in the combustion chamber).

After the outer needle 42 is closed, the inner needle 43 still continues to move downwardly by the control pressure Ps and the downward spring force of the coil spring SP2. As a result, the inner needle 43 starts moving into the suck chamber R2, and thereafter reaches the lowermost position (the inner lift amount=0). As explained here, the above-mentioned "outer needle first closing" is accomplished by the spring force of the coil spring SP1 being set to a value sufficiently larger than the spring force of the coil spring SP2.

As explained above, in the first embodiment of the fuel injection control device according to the invention, after the outer needle 42 is closed, the inner needle 43 moves into the suck chamber R2. In other words, the volume of the suck chamber R2 decreases. Accordingly, after the outer needle 42 is closed, the fuel remaining in the suck chamber R2 (in other words, in the dead volume) is immediately pushed to the combustion chamber via the injection bores 41*b* by the movement of the inner needle 43 into the suck chamber R2. Further, in this embodiment, as explained above, even when the inner needle 43 reaches the lowermost position, a small dead volume remains in the suck chamber R2. However, all fuel remaining in this small dead volume may move into the combustion chamber via the injection bores 41*b* by means of inertia of the flow of the fuel already formed in the suck chamber R2 until the inner needle 43 reaches the lowermost position. Accordingly, in the SMS type fuel injection control device, the "post drip of the fuel" can be restricted by the inner needle 43 having a function to push the fuel remaining in the suck chamber R2 by the "outer needle first closing". As a result, the increase of the amount of the discharge of the unburned hydrocarbon due to the "post drip of the fuel" can be restricted.

Figure 7:
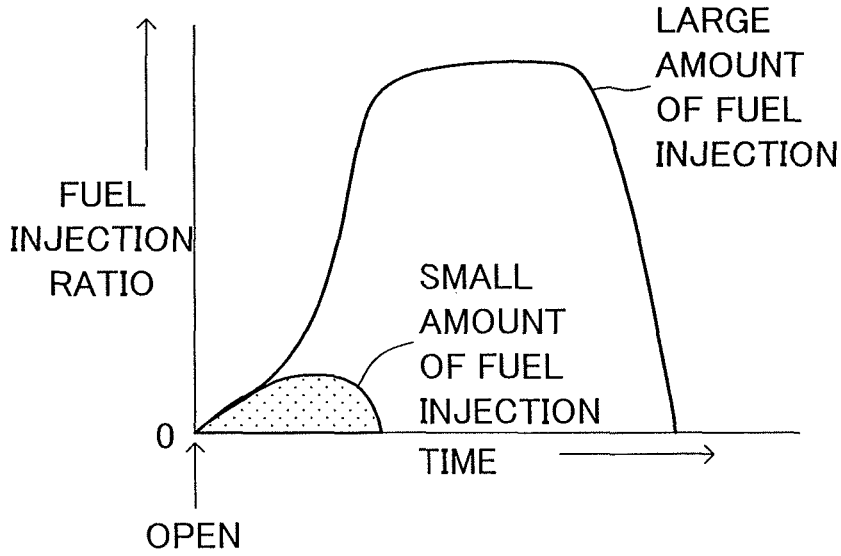
FIG. 7 is a graph showing the changes of the fuel injection ratios at the small amount of the fuel injection and at the large amount of the fuel injection after the fuel injection is started in the case that the device shown in FIG. 1 is applied.

Further, only in the case that the outer lift amount is small (between 0 and Z), the inner needle 43 has a function to form the "annular throttle" in the suck chamber R2 by the "outer needle first opening". Thereby, as shown in FIG. 7, at the small amount of the fuel injection (i.e. at the small engine load), the fuel injection ratio is restricted to a small ratio, and therefore the fuel spray having a weak penetration is formed. Accordingly, the increase of the amount of the discharge of the unburned hydrocarbon due to the overlean is restricted. On the other hand, at the large amount of the fuel injection (i.e. at the middle or large engine load), the restriction of the fuel injection ratio is released after the outer lift amount exceeds Z, and therefore the fuel spray having a strong penetration is formed. Accordingly, the increase of the amount of the production of the smoke can be restricted and the output of the engine can be increased.

The present invention is not limited to the first embodiment, and therefore any various modified embodiments can be employed within the scope of the present invention. For example, in the first embodiment, as shown in FIG. 1, etc., a thin cylindrical clearance is inevitably formed between the sliding portions of the outer and inner needles 42 and 43 (the portion of the cylindrical inner wall surface of the outer needle 42 and the portion of the cylindrical outer wall surface of the inner needle 43 opposed to each other). Accordingly, in the condition that the outer needle 42 is closed, the fuel having the control pressure Ps (=the rail pressure Pc (high pressure)) in the control chamber R3 may leak into the suck chamber R2 via the clearance. As a result, the leaked fuel may leak into the combustion chamber via the injection bores 41*b*.

Figure 8:
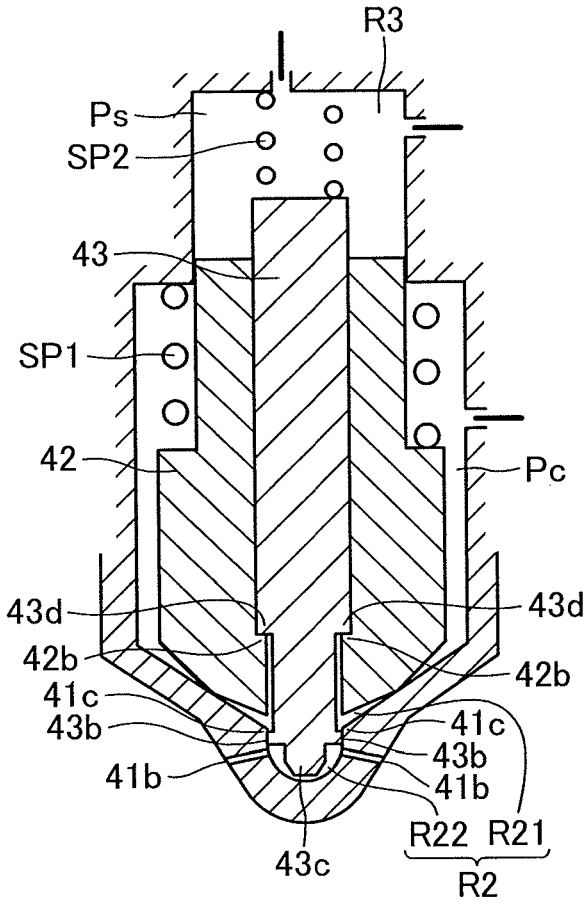
FIG. 8 is a schematic configuration view of outer and inner needles and the surroundings thereof of a fuel injection control device of a modified embodiment of the first embodiment according to the invention.

FIG. 8 shows a modified embodiment of the first embodiment constituted to restrict the above-explained leakage of the fuel. Members shown in FIG. 8 having the same functions as or the functions relevant to those of the members shown in the above-referred figures are indicated by the same reference numbers as those used in the above-referred figures, and therefore the explanations of the members shown in the above-referred figures are applied to those shown in FIG. 8. This is applied to the members shown in the figures referred below.

As shown in FIG. 8, in the modified embodiment, a stepped surface (planner face) 42*b* (corresponding to the above-mentioned first engagement portion of the outer needle) extending perpendicularly to the axial direction, is formed in the cylindrical inner wall of the outer needle 42, and a stepped surface (planner face) 43*d* (corresponding to the above-mentioned first engagement portion of the inner needle) extending perpendicularly to the axial direction, is formed in the cylindrical outer wall of the inner needle 43.

As explained above, in the condition that the outer needle 42 is closed, the downstream suck pressure Psc2 is sufficiently low, compared with the rail pressure Pc. Accordingly, the stepped surface 42*b* of the outer needle 42 and the stepped surface 43*d* of the inner needle 43 are contacted and pressed to each other by the downward force exerting on the inner needle 43 by the control pressure Ps (=the rail pressure Pc) (and the coil spring SP2). Thereby, a seal part is formed in the contact portions (the contact surfaces) formed by the stepped surfaces 42*b* and 43*d*. As a result, in the condition that the outer needle 42 is closed, the control and suck chambers R3 and R2 are fluidically separated from each other, and therefore the above-explained leakage of the fuel from the control chamber R3 to the suck chamber R2 via the clearance, can be restricted.

It should be noted that when the area of the contact surface formed by the stepped surfaces 42*b* and 43*d* is excessively large, a so-called linking action becomes large, and therefore the contacted stepped surfaces 42*b* and 43*d* are unlikely to separate from each other. Accordingly, it is preferred that the area of the contact surfaces formed by the stepped surfaces 42*b* and 43*d* is small.

In this modified embodiment, along with the opening of the outer needle 42 (the increase of the outer lift amount from 0), the inner needle 43 starts moving upwardly simultaneously (the inner lift amount starts increasing from 0) by the stepped surface 43*d* of the inner needle 43 being pressed by the stepped surface 42*b* of the outer needle 42. Thereby, it is prevented that the inner lift amount becomes smaller than the outer lift amount, and therefore the above-mentioned "outer needle first opening" is accomplished. Accordingly, the flange portion 43*a* of the inner needle 43 is removed. Further, similar to the first embodiment, the "outer needle first closing" is accomplished by the spring force of the coil spring SP1 being set to a value sufficiently larger than the spring force of the coil spring SP2.

Second Embodiment

Next, a fuel injection control device of the second embodiment according to the invention will be explained. As explained above, in the first embodiment, in order to surely accomplish the "outer needle first closing", the spring force of the coil spring SP1 is set to a value sufficiently larger than that of the coil spring SP2.

Figure 9:
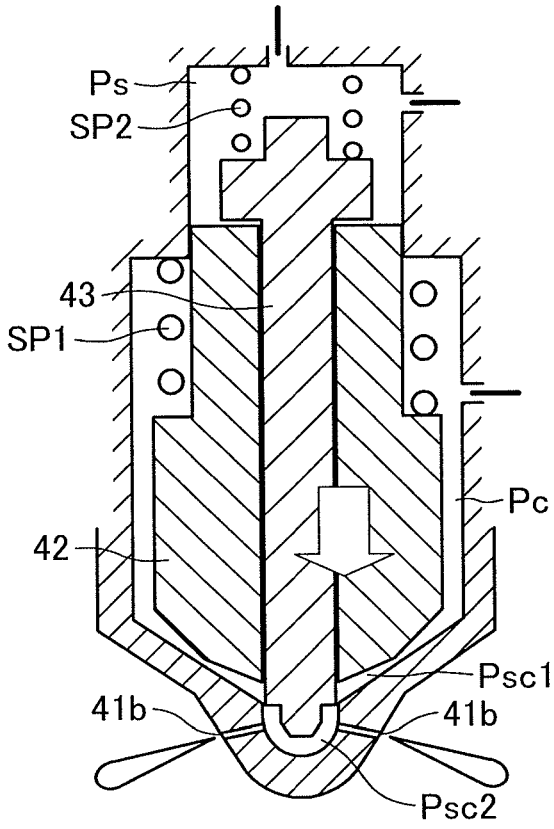
FIG. 9 is a view showing the condition that an annular throttle is formed before the outer needle is closed.

Further, as shown in FIG. 9, a case will be considered that the inner lift amount becomes smaller than or equal to Z before the outer needle 42 is closed (the outer lift amount>0) while the outer and inner needles 42 and 43 are moving downwardly. In this case, the above-mentioned "annular throttle" is formed, and therefore the downstream suck pressure Psc2 becomes lower than the upstream suck pressure Psc1 by the above-mentioned pressure loss due to the "annular throttle". Thereby, the downward force exerting on the inner needle 43 by the control pressure Ps becomes sufficiently large, compared with the upward force exerting on the inner needle 43 by the downstream suck pressure Psc2, and therefore the rate of downward movement of the inner needle 43 becomes. large. As a result, the inner needle 43 easily reaches the lowermost position before the outer needle 42 is closed (i.e. the "outer needle first closing" may not be accomplished).

In order to surely accomplish the "outer needle first closing" in consideration of this circumstances, it is necessary to set the spring force of the coil spring SP1 to a value substantially larger than the spring force of the coil spring SP2, and as a result the coil spring SP1 becomes substantially large. The second embodiment can surely accomplish the "outer needle first closing" even when the coil spring SP1 is not large. Below, only difference between the second and first embodiments will be explained.

Figure 10:
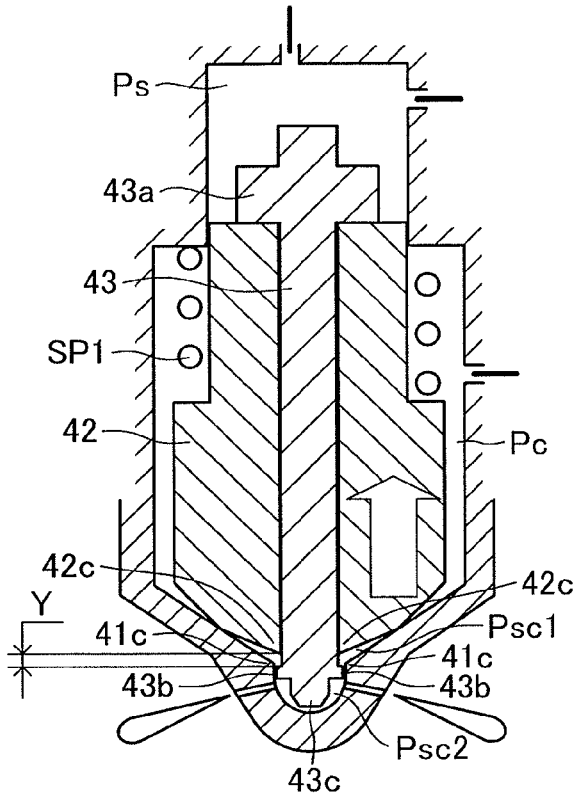
FIG. 10 is a view showing the condition of outer and inner needles immediately before a fuel injection starts in a fuel injection control device of the second embodiment according to the invention.

As shown in FIG. 10, in the second embodiment, the coil spring SP2 for biasing the inner needle 43 downwardly is removed. In addition, the tip end portion 43*b* of the inner needle 43 used to form the "annular throttle" has a ring-like flange shape. The lower tip end 42*c* of the outer needle 42 (corresponding to the above-mentioned second engagement portion of the outer needle) may abut to the upper end surface of the tip end portion 43*b*.

As shown in FIG. 10, in the condition that the outer needle 42 is closed and the lower end surface of the flange portion 43*a* of the inner needle 43 abuts to the upper end surface of the outer needle 42 (i.e. the outer lift amount=the inner lift amount=0), the upper end surface of the tip end portion 43*b* and the tip end 42*c* are apart from each other by a distance Y (corresponding to the above-mentioned second predetermined amount) in the axial (up-down) direction. Accordingly, the contact of the upper end surface of the tip end portion 43*b* and the tip end 42*c* to each other prevents the inner lift amount from becoming larger than "an amount larger than the outer lift amount by Y" (or prevents the outer lift amount from becoming smaller than "an amount smaller than the inner lift amount by Y").

Figure 11:
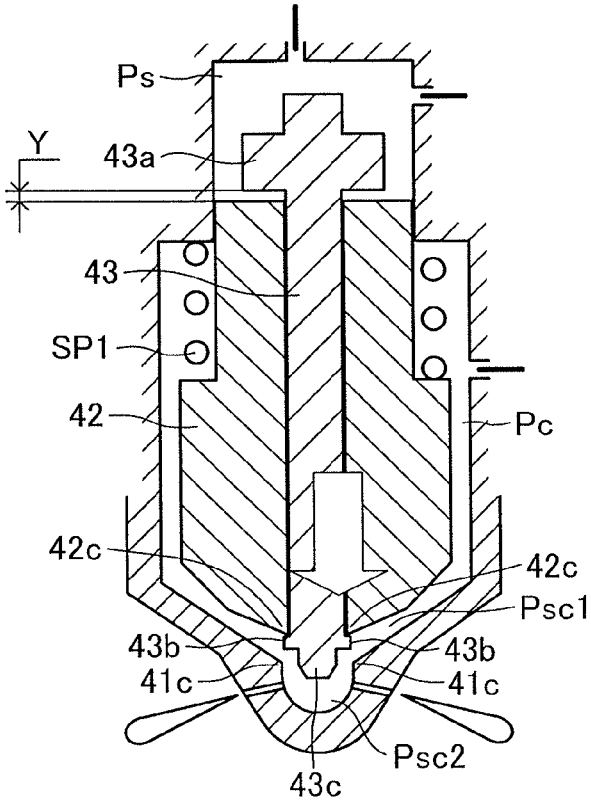
FIG. 11 is a view showing the condition of the outer and inner needles when the needles sufficiently move upwardly in the device shown in FIG. 10.

Below, the operation of the second embodiment will be explained, referring to FIGS. 10-12. In the condition of the outer lift amount=the inner lift amount=0 as shown in FIG. 1, when the control valve 44 is opened according to the instructions from the ECU 50, similar to the first embodiment, the outer needle 42 is opened by the decrease of the control pressure Ps, and thereafter the outer and inner needles 42 and 43 move upwardly while the contact of the lower end surface of the flange portion 43*a* of the inner needle 43 and the upper end surface of the outer needle 42 to each other, is maintained and the outer and inner lift amounts are maintained the same amount. Accordingly, similar to the first embodiment, the "outer needle first opening" is accomplished.

Thereafter, when the control valve 44 is closed according to the instructions from the ECU 50, along with the increase of the control pressure Ps, only outer needle 42 starts moving downwardly by the spring force of the coil spring SP1. As shown in FIG. 11, when the outer lift amount reaches an amount smaller than the inner lift amount by Y, the tip end 42*c* starts contacting to the upper end surface of the tip end portion 43*b*. Thereby, the upper end surface of the tip end portion 43*b* is pressed by the tip end 42*c*, and therefore the inner needle 43 also starts moving downwardly.

Henceforth, the upper end surface of the tip end portion 43*b* continues to be pressed by the tip end 42*c*, and therefore the inner needle 43 moves downwardly integrally with the outer needle 42 (the outer lift amount decreases while it is maintained smaller than the inner lift amount by Y).

Figure 12:
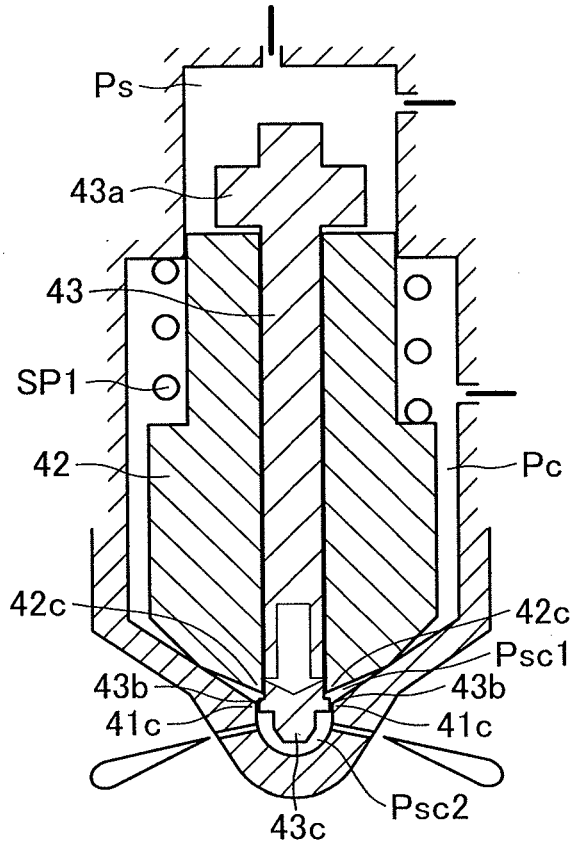
FIG. 12 is a view showing the condition of the outer and inner needles immediately before the fuel injection is terminated in the device shown in FIG. 10.

As shown in FIG. 12, when the outer needle 42 is closed (the outer lift amount=0), the fuel injection is terminated and the upstream and downstream suck pressures Psc1 and Psc2 decrease to a sufficiently low pressure (generally equal to the pressure in the combustion chamber), compared with the rail pressure Pc. As a result, the upward force exerting on the inner needle 43 by the downstream suck pressure Psc2 becomes smaller than the downward force exerting on the inner needle 43 by the increasing control pressure Ps. Accordingly, after the outer needle 42 is closed, the inner needle 43 continues to move downwardly by the downward force exerted by the control pressure Ps (the inner lift amount decreases from Y.). As a result, the inner needle 43 starts moving into the suck chamber R2, and thereafter reaches the lowermost position (the inner lift amount=0).

As explained above, in the second embodiment, the above-mentioned "outer needle first closing" can be accomplished by means of the contact of the upper end surface of the tip end portion 43*b* and the tip end 42*c* to each other, even when the coil spring SP2 is not provided. Accordingly, it is not necessary to employ the coil spring SP1 having a large spring force in order to accomplish the "outer needle first closing", and therefore the small coil spring SP1 can be employed.

The present invention is not limited to the second embodiment, and therefore various modified embodiments can be employed within the scope of the present invention. For example, in the second embodiment, as shown in FIG. 10 etc., the upper and lower ends of the outer needle 42 abut to the flange portions (43*a* and 43*b*), respectively provided on the upper and lower portions of the inner needle 43, respectively. Accordingly, the assembling of the outer and inner needles 42 and 43 is substantially difficult.

Figure 13:
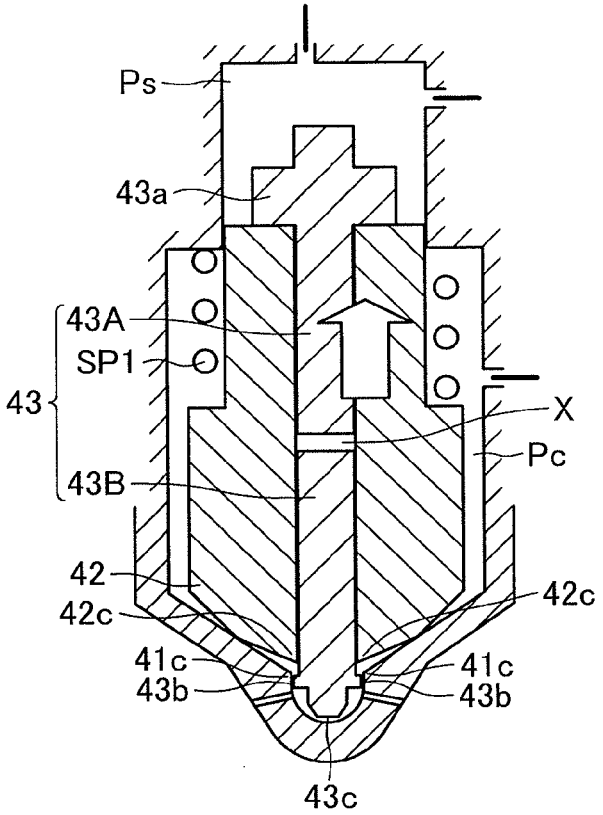
FIG. 13 is a view showing the condition of outer and inner needles immediately before a fuel injection starts in a fuel injection control device of a modified embodiment of the second embodiment according to the invention.

FIG. 13 shows a modified embodiment of the second embodiment having a constitution in order to facilitate the assembling of the outer and inner needles 42 and 43. As shown in FIG. 13, in the modified embodiment, the inner needle 43 is divided into upper and lower inner needles 43A and 43B in the up-down direction. Thereby, the assembling of the outer and inner needles 42 and 43 is substantially facilitated.

Figure 14:
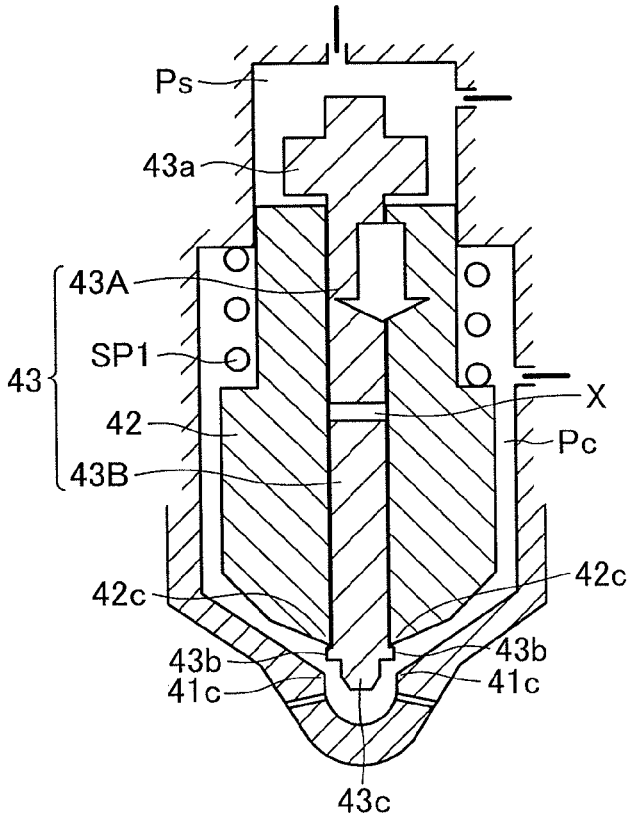
FIG. 14 is a view showing the condition of the outer and inner needles when the needles sufficiently move upwardly in the device shown in FIG. 13.

Below, the operation of the modified embodiment will be briefly explained, referring to FIGS. 13 and 14. As shown in FIG. 13, when the outer needle 42 is opened along with the opening of the control valve 44, only upper inner needle 43A moves upwardly integrally with the outer needle 42 (the lower inner needle 43B does not move upwardly), while the contact of the lower end surface of the flange portion 43*a* of the upper inner needle 43A and the upper end surface of the outer needle 42 to each other, is maintained.

Accordingly, the upper and lower inner needles 43A and 43B move apart from each other, and therefore the volume of the space X formed therebetween increases and the pressure in the space X decreases. As a result, the upward force exerting on the lower inner needle 43B by the downstream suck pressure Psc2 becomes large, compared with the downward force exerting on the lower inner needle 43B by the pressure in the space X. Thereby, the lower inner needle 43B moves upwardly, following the upper inner needle 43A.

Thereafter, along with the closing of the control valve 44, only outer needle 42 starts moving downwardly by the spring force of the coil spring SP1. As shown in FIG. 14, when the tip end 42*c* of the outer needle 42 contacts to the upper end surface of the tip end portion 43*b* of the lower inner needle 43B, subsequently, the upper end surface of the tip end portion 43*b* is pressed by the tip end 42*c*, and therefore the lower inner needle 43B moves downwardly integrally with the outer needle 42. Further, along with the increase of the control pressure Ps, the upper inner needle 43A moves downwardly by the downward force exerted by the control pressure Ps. Accordingly, in the modified embodiment, the operation similar to that of the second embodiment can be accomplished.

Third Embodiment

Next, a fuel injection control device of the third embodiment according to the invention will be explained. The third embodiment is different from the first and second embodiments, mainly in the point that in the third embodiment, the control chambers are independently provided relative to the outer and inner needles 42 and 43, respectively, while in the first and second embodiments, the common single control chamber R3 is provided relative to the outer and inner needles 42 and 43. Below, only the difference will be explained, referring to FIG. 15. It should be noted that in FIG. 15, the constitutions of the outer and inner needles 42 and 43 of the modified embodiment of the first embodiment is employed, however the constitutions of the outer and inner needles 42 and 43 of the first embodiment may be employed.

Figure 15:
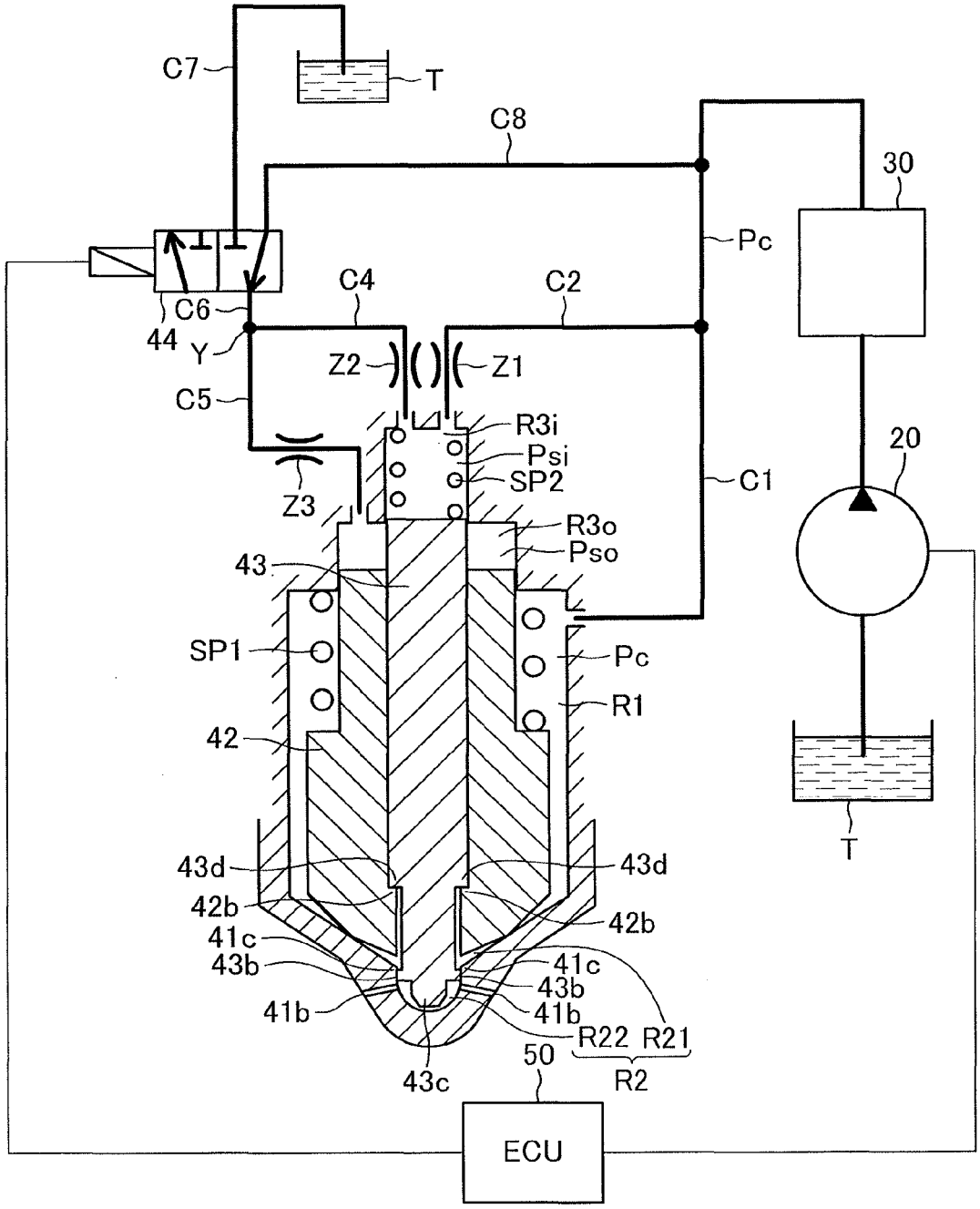
FIG. 15 is a schematic configuration view of the entire of a fuel injection control device of the third embodiment according to the invention.

As shown in FIG. 15, in the third embodiment, outer and inner control chambers R3*o* and R3*i* are independently provided relative to the outer and inner needles 42 and 43, respectively. The inner control chamber R3*i* is connected to a fluid passage C2 wherein an orifice Z1 is positioned and a fluid passage C4 wherein an orifice Z2 is positioned, and the outer control chamber R3*o* is connected to a fluid passage C5 wherein an orifice Z3 is positioned.

The fluid passage C2 is connected to the fuel supply passage C1. The portion Y wherein the fluid passages C4 and C5 converge on, is connected to the control valve 44 which is 3-port 2-position switching valve via a fluid passage C6. The control valve 44 is also connected to a fluid passage C7 connected to the fuel tank T and a fluid passage C8 connected to the fuel supply passage C1.

Figure 16:
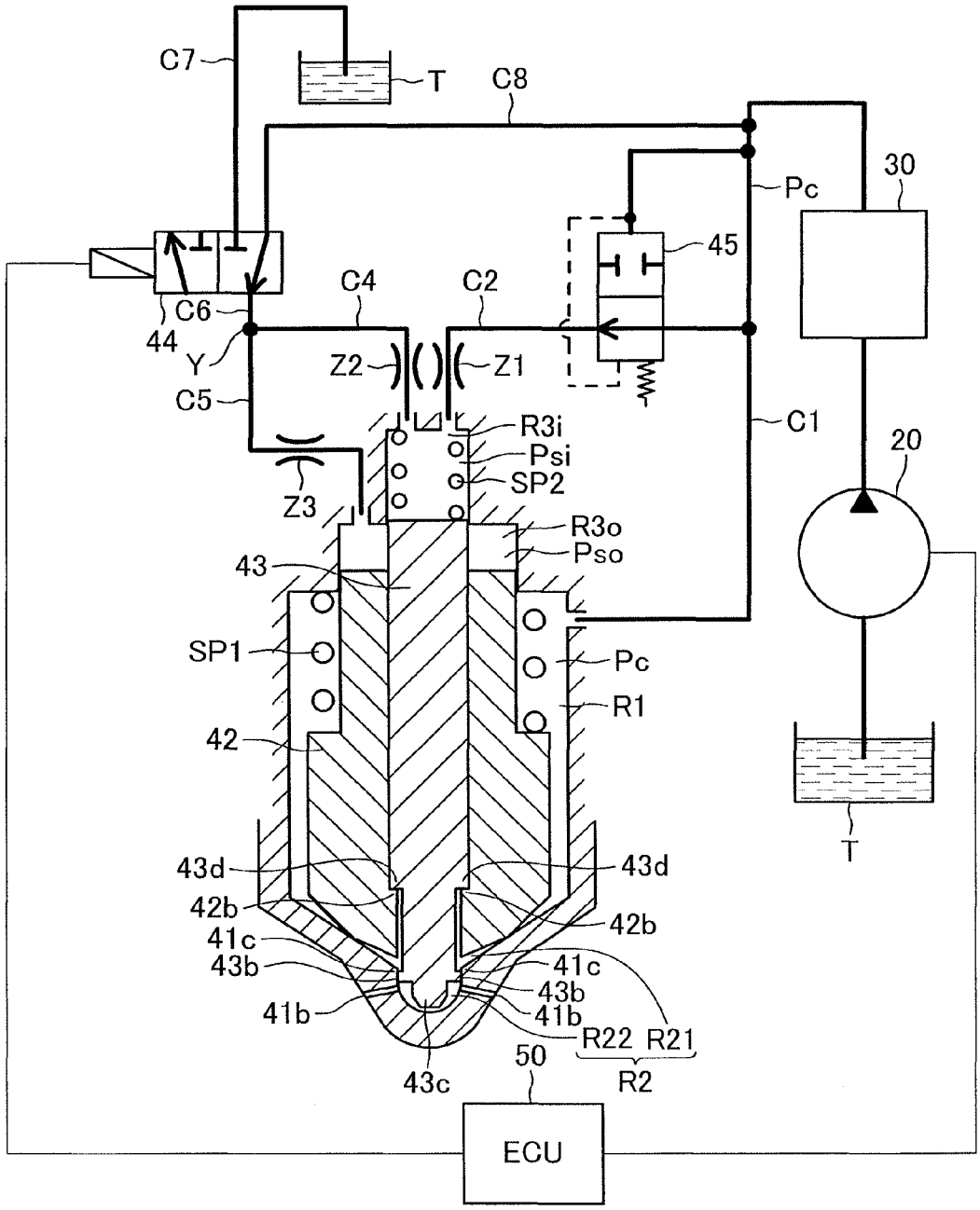
FIG. 16 is a schematic configuration view of the entire of a fuel injection control device of a modified embodiment of the third embodiment according to the invention.

Thereby, in the condition (the closed condition) that the control valve 44 is in the first position shown in FIG. 16, the fuel flows into the inner control chamber R3*i* from the fuel supply passage C1 via the fluid passage C2 and the fluid passages C8, C6 and C4, while the fuel flows into the outer control chamber R3*o* from the fuel supply passage C1 via the fluid passages C8, C6 and C5. Accordingly, in this case, the fluid passage C2 and the fluid passages C8, C6 and C4 correspond to the above-mentioned inner fuel inflow passage, while the fluid passages C8, C6 and C5 correspond to the above-mentioned outer fuel inflow passage.

On the other hand, in the condition (the open condition) that the control valve 44 is in the second position different from the first position, the fuel is discharged from the inner control chamber R3*i* to the fuel tank T via the fluid passages C4, C6 and C7, while the fuel is discharged from the outer control chamber R3*o* to the fuel tank T via the fluid passage C5, C6 and C7. Accordingly, in this case, the fluid passage C4 corresponds to the above-mentioned inner fuel outflow passage, the fluid passage C5 corresponds to the above-mentioned outer fuel outflow passage, and the fluid passages C6 and C7 correspond to the above-mentioned fuel discharge passage. It should be noted that even when the control valve 44 is in the open condition, the fuel flows into the inner control chamber R3*i* via the fluid passage C2.

As explained above, the pressure (the outer control pressure Pso) in the outer control chamber R3*o* and the pressure (the inner control pressure Psi) in the inner control chamber R3*i* can be independently controlled by independently providing the outer and inner control chambers R3*o* and R3*i* relative to the outer and inner needles 42 and 43, respectively.

Concretely, for example, the opening area S1, S2 and S3 of the orifices Z1, Z2 and Z3 are set as S3>S1+S2. After the control valve 44 is opened (i.e. after the control valve is switched from the first position to the second position), the fuel flows out from the inner control chamber R3*i* at the flow rate (corresponding to (S2−S1)) equal to the difference in the flow rate between the fuel flowing through the orifice Z2 and the fuel flowing through the orifice Z1, while the fuel flows out from the outer control chamber R3*o* at the flow rate (corresponding to S3) flowing through the orifice Z3.

In the process, since S1, S2 and S3 are set as S3>S1+S2, the total outflow rate from the outer control chamber R3*o* can be set to a rate larger than that from the inner control chamber R3*i*. Accordingly, the outer and inner control pressures Pso and Psi can be decreased such that the relationship Pso<Psi is maintained. Thereby, the "outer needle first opening" can be easily accomplished.

On the other hand, after the control valve 44 is closed (after the control valve is switched from the second position to the first position), the fuel flows into the inner control chamber R3*i* at the flow rate (corresponding to (S1+S2)) equal to the sum of the inflow rates of the fuel flowing through the orifices Z1 and Z2, while the fuel flows into the outer control chamber R3*o* at the inflow rate (corresponding to S3) of the fuel flowing through the orifice Z3.

In the process, since S1, S2 and S3 are set as S3>S1+S2, the total inflow rate into the outer control chamber R3*o* can be set to a rate larger than that into the inner control chamber R3*i*. Accordingly, the outer and inner control pressures Pso and Psi can be increased such that the relationship Pso>Psi is maintained. Thereby, the "outer needle first closing" can be easily accomplished. In other words, even when the spring force of the coil spring SP1 is small, the "outer needle first closing" can be accomplished. As a result, the small coil spring SP1 can be employed.

The present invention is not limited to the third embodiment, and therefore various modified embodiments can be employed within the scope of the present invention. For example, as shown in FIG. 16, an on-off valve 45 which is a 2-port 2-position on-off valve may be positioned in the fluid passage C2 (corresponding to the above-mentioned inner fuel inflow passage). The on-off valve 45 opens the fluid passage C2 when the pressure (the rail pressure Pc) in the fluid supply passage C1 is lower than a predetermined pressure, and closes the fluid passage C2 when the rail pressure Pc exceeds the predetermined pressure.

Figure 17:
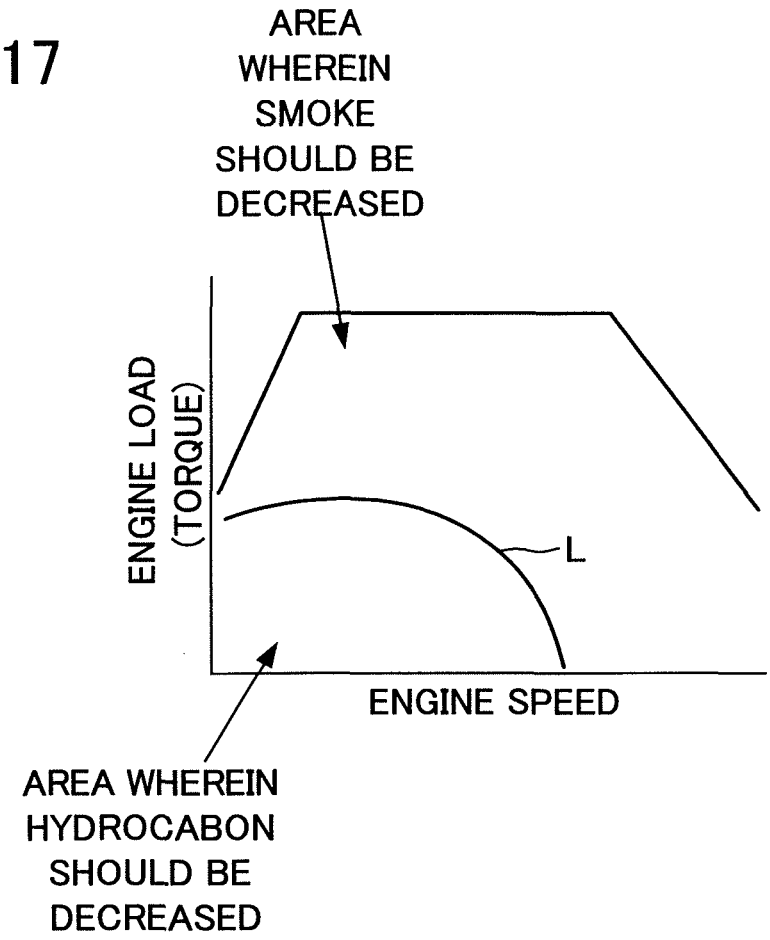
FIG. 17 is a graph showing the relationship between the engine speed, the engine load, the area wherein the unburned hydrocarbon should be decreased, and the area wherein the smoke should be decreased.

As shown in FIG. 17, generally, when the engine operation is in the area of the small engine speed and the small engine load (output torque) (in the figure, the lower-left side area of the curve L), in particular, the unburned hydrocarbon should be decreased since the compression end temperature in the combustion chamber is relatively low. On the other hand, when the engine operation is in the area of the large engine speed and the large engine load (output torque) (in the figure, the upper-right side area of the curve L), in particular, the smoke should be decreased since the compression end temperature in the combustion chamber is relatively high.

Figure 18:
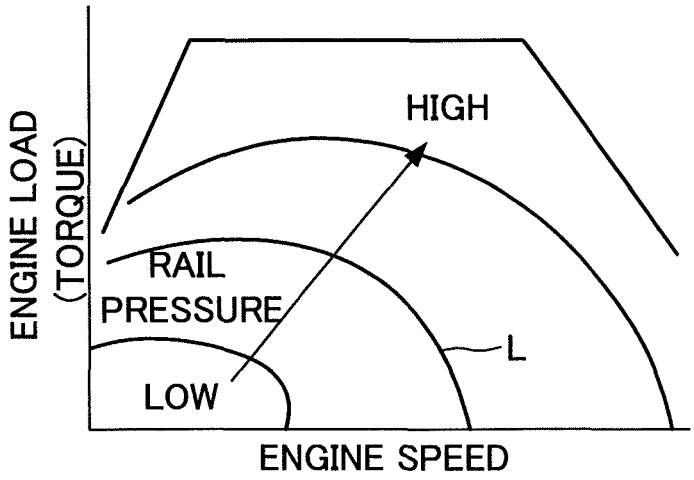
FIG. 18 is a graph showing the relationship between an engine speed, an engine load, and a rail pressure.

As shown in FIG. 18, in this modified embodiment, the rail pressure Pc is changed depending on the engine speed and the engine load (output torque), and the rail pressure Pc is changed to a large value as the engine speed and the engine load are large. In FIG. 18, the above-mentioned predetermined pressure is the rail pressure Pc on the curve L.

In addition, in this modified embodiment, the open area S1, S2 and S3 of the orifices Z1, Z2 and Z3 are set as S3>(S2−S1) and S3<S2.

In this case, when the rail pressure Pc is lower than or equal to a predetermined pressure (generally, at the small engine load), the on-off valve 45 is opened to open the fluid passage C2. As a result, after the control valve 44 is opened (i.e. after the control valve is switched from the first position to the second position), the fuel flows out from the inner control chamber R3*i* at a flow rate (corresponding to (S2−S1)) equal to the difference between the outflow rate of the fuel flowing through the orifice Z2 and the inflow rate of the fuel flowing through the orifice Z1, while the fuel flows out from the outer control chamber R3*o* at the outflow rate (corresponding to S3) of the fuel flowing through the orifice Z3.

In the process, since S1, S2 and S3 are set as S3>S2−S1, the total outflow rate from the outer control chamber R3*o* can be set to a rate larger than that from the inner control chamber R3*i*. Accordingly, the outer and inner control pressures Pso and Psi can be decreased such that the relationship Pso<Psi is maintained. Thereby, the "outer needle first opening" can be easily accomplished. Therefore, at the small engine load, as explained above, the penetration of the fuel spray can be weakened by the action of the "annular throttle", and therefore the increase of the amount of the discharge of the unburned hydrocarbon due to the overlean can be restricted.

On the other hand, when the rail pressure Pc is high (generally, at the middle or large engine load), the on-off valve 45 is closed to close the fluid passage C2. As a result, after the control valve 44 is opened (i.e. after the control valve is switched from the first position to the second position), the fuel flows out from the inner control chamber R3*i* at the outflow rate (corresponding to S2) of the fuel flowing through the orifice Z2, while the fuel flows out from the outer control chamber R3*o* at the outflow rate (corresponding to S3) of the fuel flowing through the orifice Z3.

In the process, since S3 and S2 are set as S3<S2, the total outflow rate from the outer control chamber R3*o* can be smaller than that from the inner control chamber R3*i*. Accordingly, the outer and inner control pressures Pso and Psi can be decreased such that the relationship Pso>Psi is maintained. Thereby, the above-mentioned "inner needle first opening" can be accomplished.

The "annular throttle" can be disappeared by the inner lift amount exceeding Z by the "inner needle first opening" before the outer needle 42 is opened. Accordingly, after the outer needle 42 is opened, at the beginning, the condition that there is no "annular throttle" can be obtained, and therefore immediately after the outer needle 42 is opened, the original property of the above-mentioned SMS type itself functions, and accordingly the fuel spray having a strong penetration can be formed. Accordingly, at the middle or large engine load, the "inner needle first opening" is accomplished, and therefore the increase of the amount of the production of the smoke can be further restricted and the output of the engine can be further increased, compared with the case that the "outer needle first opening" is accomplished.

Further, in this modified embodiment, the spring force of the coil spring SP1 is set to a value sufficiently larger than the spring force of the coil spring SP2. Accordingly, independently of the open or closed condition of the on-off valve 45 (i.e. independently of the rail pressure Pc), similar to the first embodiment, the "outer needle first closing" can be surely accomplished.

The present invention is not limited to the above-explained embodiments, and therefore various modified embodiments can be employed within the scope of the present invention. For example, in the above-explained embodiments (except for the modified embodiment of the third embodiment), the case that the outer and inner lift amounts simultaneously increase from zero is employed as the "outer needle first opening", however the embodiments can be constituted such that the outer lift amount increases from zero prior to the increase of the inner lift amount from zero.

Further, in the above-explained embodiments (except for the modified embodiment of the third embodiment), the "annular throttle" is formed as the above-mentioned throttle portion, however the embodiments can be constituted such that the above-mentioned throttle portion is not formed. In this case, since the "outer needle first opening" is not necessary, the embodiments can be constituted such that the inner lift amount increases from zero prior to the increase of the outer lift amount from zero.

Figure 19:
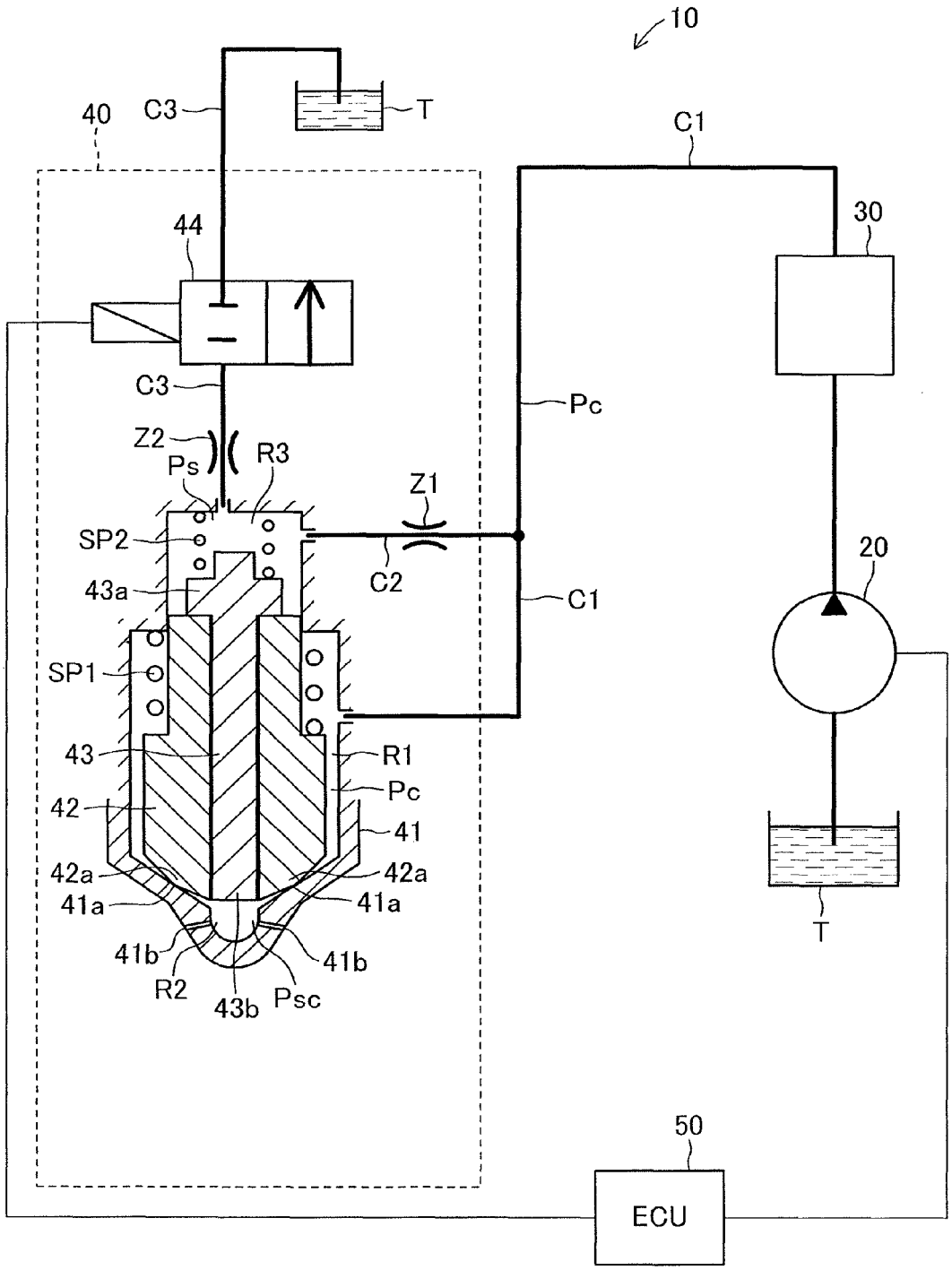
FIG. 19 is a schematic configuration view similar to FIG. 1 and showing the entire of a fuel injection control device wherein the lower tip end portion of the inner needle does not move (project) into the suck chamber when the inner needle is in the lowermost position (the inner lift amount=0).
Figure 20:
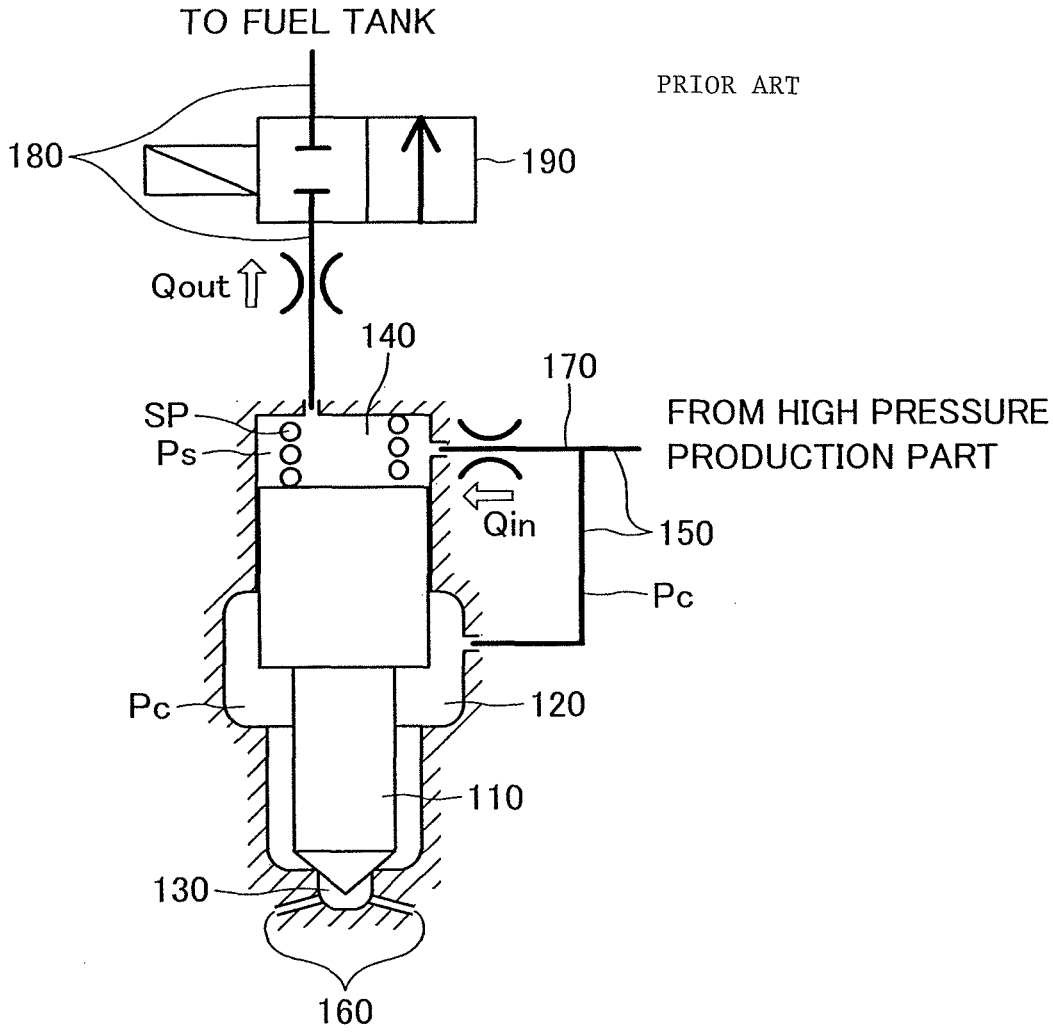
FIG. 20 is a schematic configuration view of a SMS type fuel injection control device in the prior art.
Figure 21:
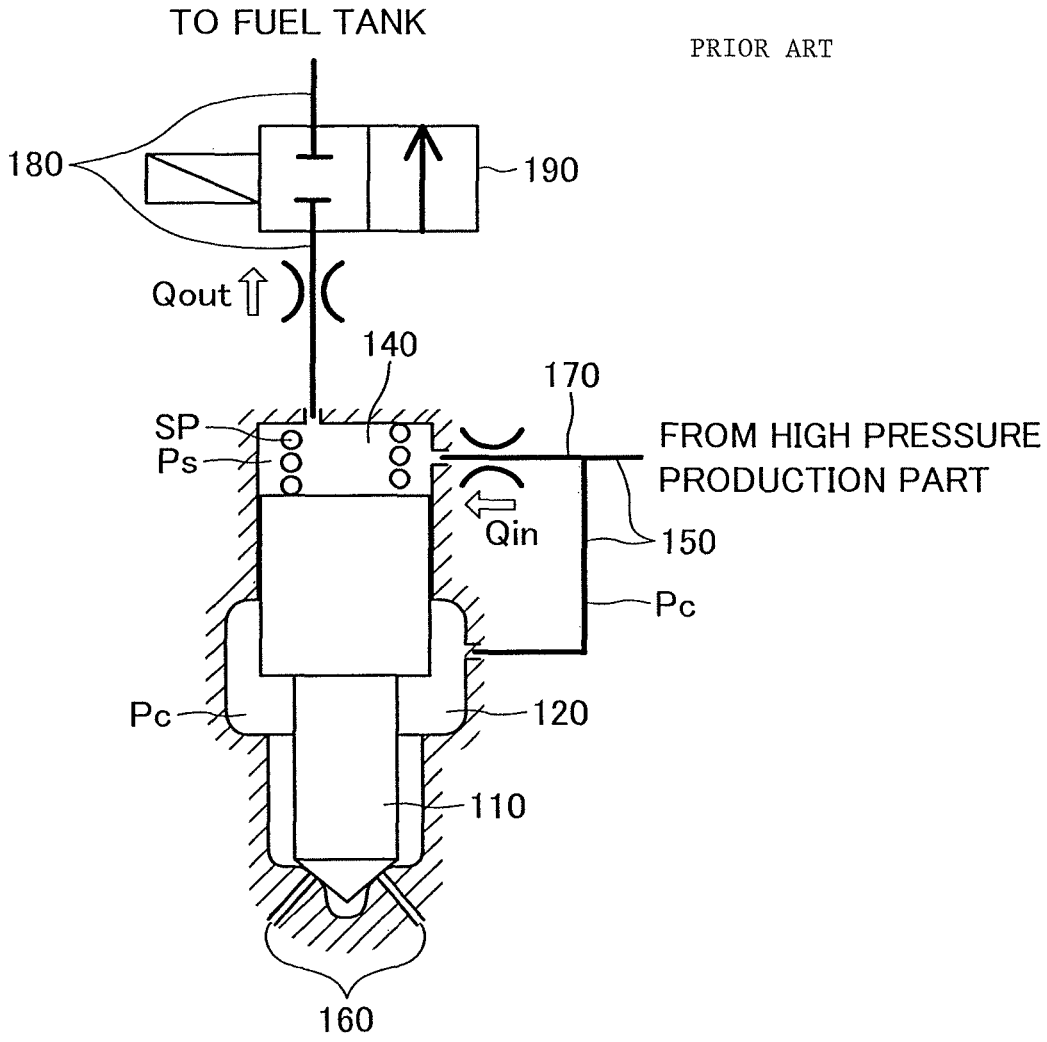
FIG. 21 is a schematic configuration view of a VCO type fuel injection control device in the prior art.

In addition, in the case that the above-mentioned throttle portion is not formed, as shown in FIG. 19, when the inner needle 43 is in the lowermost position (the inner lift amount=0), the lower tip end portion 43*b* of the inner needle 43 can be constituted such that the lower tip end portion 43*b* does not move (project) into the suck chamber R2. Thereby, the inner needle 43 has a function to push out the fuel remaining in the suck chamber R2 by the "outer needle first closing", and therefore the "post drip of the fuel" can be restricted. As a result, the increase of the amount of the discharge of the unburned hydrocarbon due to the "post drip of the fuel" can be restricted.

The invention claimed is:

1. A fuel injection control device, comprising:

a body having, in an interior thereof, one or more injection bores configured to face a combustion chamber of an engine at a tip end portion of said body at one end side of said body, a suck chamber connected to the one or more injection bores, the suck chamber including an upstream chamber portion and a downstream chamber portion, a nozzle chamber configured to store fuel at a rail pressure, said nozzle chamber located upstream of the upstream chamber portion of the suck chamber; and a valve seated portion;

a tubular outer needle axially movably housed in the interior of said body, said outer needle including a seat portion provided in a tip end portion of the outer needle at one end side of the outer needle, the seat portion being located opposite the valve seated portion; wherein the tubular outer needle is configured to shut said suck chamber from said nozzle chamber in a closed condition such that the seat portion and the valve seated portion abut each other, and wherein said outer needle is configured to allow communication between the suck chamber and the nozzle chamber in an open condition such that said outer needle moves from the closed condition toward an other end side of said outer needle and said seat portion and said valve seated portion are apart from each other;

an inner needle housed in an interior of said outer needle such that said inner needle can slide axially relative to said outer needle;

means for regulating an outer lift amount corresponding to a movement amount of said outer needle from the closed condition toward the other end side of said outer needle;

means for regulating an inner lift amount corresponding to a movement amount of said inner needle from a lowermost position corresponding to a most one end side position within a range of possible movement of said inner needle relative to said body; and means for forming a throttle portion to throttle a part of a fuel flow path formed in said suck chamber from said nozzle chamber to said injection bores in the open condition of said outer needle only when the inner lift amount is between zero and a first predetermined amount larger than zero;

wherein the fuel injection control device is configured such that when said outer needle is in the open condition, fuel stored in said nozzle chamber is injected from said injection bores to said combustion chamber via said suck chamber;

wherein said outer lift amount regulating means includes:

an outer control chamber provided at the other end side of said outer needle, the other end of said outer needle being subject to a force in a direction of the one end side by an outer control pressure corresponding to a pressure of fuel in said outer control chamber;

wherein said inner lift amount regulating means includes:

an inner control chamber provided at the other end side of said inner needle independently of said outer control chamber, the other end of said inner needle being subject to a force in the one end side direction by an inner control pressure corresponding to a pressure of fuel in said inner control chamber;

the fuel injection control device further comprising:

a high pressure production part for producing fuel having the rail pressure:

a fuel supply passage for connecting said high pressure production part and said nozzle chamber to each other;

an outer fuel passage for connecting said fuel supply passage and said outer control chamber to each other, the outer fuel passage being connected to the outer control chamber at one end of the outer fuel passage;

an inner fuel inflow passage for connecting said fuel supply passage and said inner control chamber to each other;

an inner fuel outflow passage connected to said inner control chamber at an upstream end of the inner fuel outflow passage and converging on said outer fuel passage at a downstream end of the inner fuel outflow passage;

a fuel discharge passage for connecting the converging portion of said outer fuel passage and said inner fuel outflow passage and a fuel tank to each other; and a control valve positioned in said fuel discharge passage for opening and closing said fuel discharge passage;

wherein said outer and inner lift amount regulating means are configured to regulate the outer and inner lift amounts by controlling said control valve to independently control the outer and inner control pressures;

wherein an on-off valve is positioned in said inner fuel inflow passage for opening said inner fuel inflow passage when the rail pressure is lower than or equal to a predetermined pressure and for closing said inner fuel inflow passage when the rail pressure exceeds said predetermined pressure;

wherein said outer and inner lift amount regulating means are configured to regulate the outer and inner lift amounts such that at a start of fuel injection, when the rail pressure is lower than or equal to said predetermined pressure, the outer and inner lift amounts increase from zero simultaneously or the outer lift amount increases from zero prior to an increase of the inner lift amount from zero, such that at the start of the fuel injection, when the rail pressure exceeds said predetermined pressure, the inner lift amount increases from zero prior to the increase of the outer lift amount from zero, and such that when the fuel injection is terminated, the inner lift amount returns to zero after the outer lift amount returns to zero.

2. The fuel injection control device set forth in claim 1, wherein an annular clearance is formed by an outer peripheral surface of an outer side wall of a tip end portion of said inner needle at the one end side of said inner needle opposing to an inner peripheral surface of an inner side wall defining said suck chamber only when the inner lift amount is within a range between zero and said first predetermined amount.

3. The fuel injection control device set forth in claim 1, wherein said outer and inner lift regulating means include a first engagement mechanism which includes a first engagement portion of said outer needle and a first engagement portion of said inner needle for forbidding that the inner lift amount becomes smaller than the outer lift amount by the contact of said first engagement portions of said outer and inner needles to each other.

4. The fuel injection control device set forth in claim 3, wherein said first engagement mechanism includes a stepped surface extending generally perpendicularly to the axial direction and formed in the inner side wall of said outer needle as said first engagement portion of said outer needle, and a stepped surface extending perpendicularly to the axial direction and formed in the outer side wall of said inner needle as said first engagement portion of said inner needle.

* * * * *